US010524547B2

(12) United States Patent
Okuda et al.

(10) Patent No.: US 10,524,547 B2
(45) Date of Patent: Jan. 7, 2020

(54) MOLDED SURFACE FASTENER AND MOLDED SURFACE FASTENER MANUFACTURING METHOD

(71) Applicant: YKK Corporation, Tokyo (JP)

(72) Inventors: Kenji Okuda, Toyama (JP); Mineto Terada, Toyama (JP); Shinichi Imai, Toyama (JP); Tsuyoshi Minato, Macon, GA (US)

(73) Assignee: YKK Corporation (JP)

( * ) Notice: Subject to any disclaimer, the term of this patent is extended or adjusted under 35 U.S.C. 154(b) by 332 days.

(21) Appl. No.: 15/318,504

(22) PCT Filed: Jul. 3, 2014

(86) PCT No.: PCT/JP2014/067781
§ 371 (c)(1),
(2) Date: Dec. 13, 2016

(87) PCT Pub. No.: WO2016/002044
PCT Pub. Date: Jan. 7, 2016

(65) Prior Publication Data

US 2017/0119107 A1 May 4, 2017

(51) Int. Cl.
*A44B 18/00* (2006.01)
*A44B 13/00* (2006.01)

(52) U.S. Cl.
CPC ..... *A44B 18/0076* (2013.01); *A44B 13/0023* (2013.01); *A44B 13/0047* (2013.01);
(Continued)

(58) Field of Classification Search
CPC ..... A44B 18/0076; A44B 13/0023; A44B 13/0052; A44B 13/0047; A44B 18/0069; A44B 18/0049
See application file for complete search history.

(56) References Cited

U.S. PATENT DOCUMENTS 6,720,059 B2 4/2004 Fujisawa et al.
8,756,770 B2 * 6/2014 Cina ..... A44B 18/0049 24/452
(Continued)

FOREIGN PATENT DOCUMENTS

CN 103327845 A 9/2013
GB 2468869 A 9/2010
(Continued)

OTHER PUBLICATIONS

Office Action, Japanese Patent Application No. 2016-530761, dated Aug. 22, 2017.
(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A molded surface fastener has engagement regions in which engaging elements are disposed in an erect manner and space regions with no engaging elements, the engagement regions and the space regions alternating in the longitudinal direction. Each space region has a pair of left and right vertical wall portions that are disposed on a substrate portion in an erect manner and a convex rib portion that protrudes from the center of the substrate portion in the width direction, and the convex rib portion is integrally connected to a main lateral wall portion disposed in the width direction of the engagement region. By implementing a simple cutting process, this molded surface fastener can be easily adapted to usages in which the fastener has to be in a curved shape bending in the width direction.

13 Claims, 14 Drawing Sheets

(52) U.S. Cl.
CPC ..... *A44B 13/0052* (2013.01); *A44B 18/0049* (2013.01); *A44B 18/0069* (2013.01)

(56) References Cited

U.S. PATENT DOCUMENTS

| | | | |
|---|---|---|---|
| 2013/0000085 | A1 | 1/2013 | Cina et al. |
| 2013/0149490 | A1 | 6/2013 | Cina et al. |

FOREIGN PATENT DOCUMENTS

| | | | |
|---|---|---|---|
| JP | 3386965 | B2 | 2/2007 |
| JP | 2011-143231 | A1 | 7/2011 |
| JP | 2014-057870 | A | 4/2014 |
| WO | 2012/025980 | A1 | 3/2012 |
| WO | 2013/061423 | A1 | 5/2013 |
| WO | 2013/0061423 | A1 | 5/2013 |

OTHER PUBLICATIONS

International Search Report, PCT International Patent Application No. PCT/JP2014/067781, dated Sep. 22, 2014.
Office Action, Chinese Patent Application No. 201480080191.5, dated Nov. 28, 2018, 7 pages.
Office Action, Chinese Patent Application No. 201480080191.5, dated May 17, 2019, 8 pages.

* cited by examiner

MOLDED SURFACE FASTENER AND MOLDED SURFACE FASTENER MANUFACTURING METHOD

This application is a national stage application of PCT/JP2014/067781, which is incorporated herein by reference.

TECHNICAL FIELD

The present invention relates to a molded surface fastener that is integrated on a surface of a cushion body when the cushion body is foamed and molded, and a manufacturing method of the molded surface fastener. Particularly, the present invention relates to a molded surface fastener which can prevent a foam resin material from intruding into an engaging region when the cushion body is foamed and molded, and a manufacturing method of the molded surface fastener.

BACKGROUND ART

Passenger seats of automobiles or trains, various kinds of sofas, office chairs, and the like are often formed by attaching a skin material such as fiber fabric or natural or synthetic leather to the surface of a cushion body (foaming body) molded in a predetermined shape by using a foam resin material. The cushion body used in these various seats often has a bent surface composed of convex-concave shapes satisfying human engineering factors in order to maintain a seating posture which provides no fatigue despite long-hour seating.

When a skin material is attached to the surface of a cushion body, after molding the cushion body in a desired shape, a method of covering and fixing a skin material to the surface of the obtained cushion body is often employed. In particular, in this case, a molded surface fastener is generally used as means for fixing the surface of the cushion body and a bottom surface of the skin material.

A molded surface fastener has a configuration in which a plurality of engaging elements (male engaging elements, for example) are disposed on one surface (first surface) of a base portion made from a thermoplastic resin, and such a molded surface fastener is integrally molded so that the engaging elements are exposed to the surface of the cushion body when the cushion body is molded. Moreover, a plurality of female engaging elements configured to be fastened to the engaging elements of the molded surface fastener are formed on the bottom surface of the skin material that covers the cushion body.

After the skin material covers the cushion body to which the molded surface fastener is integrated, the female engaging elements (loop-shaped engaging elements) disposed on the bottom surface of the skin material are pressed against the male engaging elements of the molded surface fastener disposed on the surface of the cushion body, whereby the skin material is fastened to the molded surface fastener. In this manner, the skin material is easily fixed to the surface of the cushion body along the convex-concave shapes of the surface, and the skin material is prevented from floating from the cushion body.

Examples of such a molded surface fastener integrated to the cushion body for fixing the skin material are disclosed in U.S. Pat. No. 6,720,059 (Patent Document 1) and WO 2012/025980 (Patent Document 2).

In such a molded surface fastener described in Patent Documents 1 and 2, a plurality of hook-shaped engaging elements stand on a long and thin plate-shaped substrate portion to form an engaging region in which these hook-shaped engaging elements can engage with loop-shaped engaging elements. In this case, the engaging region is formed in a whole length direction of the substrate portion.

On left and right side edge portions in a width direction of the substrate portion, a pair of left and right resin intrusion barrier portions stand along the length direction so as to hold the engaging region between them.

Further, in the molded surface fastener of the Patent Document 2, a plurality of hook-shaped engaging elements are disposed in lines in the length direction and in the width direction, and lateral wall portions are disposed between the resin intrusion barrier portion and the engaging region and between engaging elements adjacent with each other in the width direction.

In a case that a cushion body is foamed and molded to integrate the molded surface fastener as in Patent Document 1 or Patent Document 2, the molded surface fastener is held at an inner surface (cavity surface) of a molding die for molding the cushion body, and a foam resin material is injected into an inner space (cavity) of the molding die. In this case, the engaging regions of the molded surface fastener can be blocked from the inner space of the molding die by the left and right resin intrusion barrier portions disposed at the molded surface fastener by that the left and right resin intrusion barrier portions of the molded surface fastener is closely contacted with the inner surface of the molding die.

As the foam molding is performed by injecting the foam resin material of the cushion body into the molding die in a state that the left and right resin intrusion barrier portions of the molded surface fastener is closely contacted with the inner surface of the molding die, the foam resin material can be prevented from flowing into the engaging region from the width direction over the left and right resin intrusion barrier portions, which enables manufacturing the cushion body to which the molded surface fastener is integrated. Further, since the above-mentioned lateral wall portions are disposed in the molded surface fastener of Patent Document 2, the foam resin material can be effectively prevented from flowing into the engaging regions from the length direction over the lateral wall portions disposed at both end edge portions in the length direction of the substrate portion.

Therefore, in the cushion body to which the molded surface fastener of Patent Document 1 or Patent Document 2 is integrated, engaging elements of the molded surface fastener can be prevented from being buried by the foaming body, and a plurality of engaging elements can be exposed on a surface of the cushion body. Thereby, in the cushion body to which the molded surface fastener is integrated, a desired engaging force by a plurality of engaging elements disposed in the engaging regions can be stably exerted, and loop-shaped engaging elements provided on a skin material can be stably engaged.

Patent Document 1 also discloses a molded surface fastener in which a plurality of peripheral wall portions disposed along the length direction with intervals, a plurality of engaging elements disposed on an inside of respective peripheral wall portions and a pair of left and right resin intrusion barrier portions standing along the length direction at left and right side edge portions of the substrate portion so as to hold the peripheral wall portions and the engaging elements between them are provided on a long and thin plate-shaped substrate portion, as an Embodiment (see FIGS. 13 and 14 of Patent Document 1).

Meanwhile, a cushion body used for a seat and the like disposed on automobiles or trains sometimes has a bent surface composed of a convex-concave shape, as mentioned above. When a molded surface fastener is attached to such a cushion body, the molded surface fastener may be integrated with the cushion body in a state that the molded surface fastener is bent in a thickness direction or a width direction, depending on a usage of the cushion body or a design of a product.

However, in the above-mentioned molded surface fastener according to Patent Document 1 or Patent Document 2, the substrate portion in which a plurality of the engaging elements and the left and right resin intrusion barrier portions are provided are formed in a thin plate-shaped and in a long shape. Therefore, it cannot be bent in the width direction. Accordingly, the molded surface fastener of Patent Document 1 or Patent Document 2 has a defect that it cannot be applied to a cushion body in which the molded surface fastener needs to be integrated in a bent state in the width direction.

In contrast, a molded surface fastener which can be integrated to a cushion body in a bent state in the width direction are disclosed in, for example, JP2011-143231A (Patent Document 3), WO2013/061423A (Patent Document 4) and US2013-0149490A (Patent Document 5).

The molded surface fastener recited in Patent Document 3, for example, is configured such that substantially fishbone-shaped hook members are adhered to a base made of polystyrene foam or nonwoven fabric. In this case, the base is configured to have left and right side wall portions disposed in parallel along the length direction and left and right flap portions extending outward from the side wall portions, and to be able to extend and shrink in the width direction.

The substantially fishbone-shaped hook members in Patent Document 3 are fixed between the left and right side wall portions of the base. The hook members also have a center rib extending along the length direction and an engaging portion extending in the width direction from the both sides of the center rib and in which a plurality of hook-shaped engaging elements are disposed on an upper surface. Constant intervals are provided between adjacent engaging portions in the length direction.

Such a molded surface fastener of Patent Document 3 can be integrated to a cushion body in a bent state in the width direction. It also can prevent the foam resin material from flowing into the engaging portions of the hook members over the left and right side wall portions of the base and intruding from the width direction when the cushion body is foamed and molded.

The molded surface fastener described in Patent Document 4 is configured that a plurality of surface fastener members on which a plurality of hook-shaped engaging elements stand on an upper surface of the flat plate-shaped substrate portion are connected along the length direction via connecting portions (monofilament) having flexibility. In each surface fastener member, a pair of left and right vertical barrier portions standing along the length direction at left and right side edge portions of the substrate portion and two rows of first and second lateral wall portions standing along the width direction at front and rear end edge portions of the substrate portion are disposed so as to surround an engaging region formed of a plurality of engaging elements.

Such a molded surface fastener of Patent Document 4 can also be integrated to a cushion body in a bent state in the width direction. Further, since the pair of left and right vertical barrier portions and front and rear first and second lateral wall portions are disposed in each surface fastener member, the foam resin material can be prevented from intruding into the engaging region of each surface fastener member when the cushion body is foamed and molded.

The molded surface fastener described in Patent Document 5 as an Embodiment (see FIGS. 5A and 5B of Patent Document 5) is configured such that a plurality of fastening segments in which a plurality of hook-shaped engaging elements stand are connected by flexible neck portions along the length direction. Each fastening segment has a substrate portion, a barrier portion standing along the length direction on the substrate portion, a segment wall portion disposed along the length direction on an outside of the barrier portion and a lateral wall portion standing along the width direction on the substrate portion.

In each fastening segment, an engaging region which is surrounded by the left and right barrier portions and the front and rear lateral wall portions, and in which the foam resin material can be prevented from intruding when the cushion body is foamed and molded is provided. Further, in Patent Document 5, engaging elements stand on an outer side of the engaging region of each fastening segment on the substrate portion, too. These outside engaging elements are buried in the cushion body which is foamed and molded, thereby fixing strength of the molded surface fastener with respect to the cushion body can be enhanced.

PRIOR ART DOCUMENT

Patent Documents

Patent Document 1: U.S. Pat. No. 6,720,059
Patent Document 2: WO 2011/025980
Patent Document 3: JP 2011-143231 A
Patent Document 4: WO 2013/061423
Patent Document 5: US 2013-0149490 A

SUMMARY OF INVENTION

Problems to be Solved by the Invention

As the molded surface fasteners according to Patent Document 1 and Patent Document 2 cannot be bent in the width direction, as mentioned above, when the molded surface fastener is integrated to the cushion body in a bent state in the width direction, it is necessary to use a curve-applicable molded surface fastener which can be bent in the width direction, as mentioned in Patent Documents 3 to 5, and has a totally different shape from the molded surface fasteners of Patent Document 1 and 2.

Therefore, a molded surface fastener used in a straight shape which does not need to be bent in the width direction and a curve-applicable molded surface fastener have to be manufactured separately with different manufacturing apparatuses and different manufacturing processes, and it has been demanded that a molded surface fastener used in a straight shape can be applied to a bend easily, from a view point of manufacturing cost or manufacturing efficiency.

For the molded surface fasteners described in Patent Documents 1 and 2, for example, by cutting off the left and right side edge portions of the substrate portion partially at several points and forming the connecting portions thereafter, the molded surface fastener having a shape in which a plurality of surface fastener members having the engaging regions are connected at the connecting portions and enabling to bend in the width direction can be obtained. In this case, however, when the connecting portions are formed later, the resin intrusion barrier portions standing along the length direction at the left and right side edge portions of the substrate portion are also partially cut off. Therefore, it has a possibility of permitting the intrusion of the foam resin material to the engaging regions of the molded surface fastener when the cushion body is foamed and molded.

On one hand, although the molded surface fastener described in Patent Document 3 can be bent in the width direction, a base for bonding and supporting the hook members is needed, in addition to the substantially fishbone-shaped hook members made of synthetic resin. Therefore, there have been also problems such as a complexed manufacturing process or increased manufacturing cost of the molded surface fastener.

In the molded surface fastener described as another Embodiment in Patent Document 3, although the base for bonding and supporting the hook members is not needed, a protection layer substantially covering each engaging portion of the hook member needs to be provided. As mentioned above, there have been problems such as a complexed manufacturing process or increased manufacturing cost of the molded surface fastener.

The molded surface fastener described in Patent Document 4 is configured such that a plurality of surface fastener members having engaging elements are connected along the length direction by a monofilament. Therefore, when the molded surface fastener is molded using a die wheel, for example, as mentioned in Patent Document 4, the molded surface fastener has to be molded while the monofilament is inserted, which results in a complexed manufacturing process or increased manufacturing cost.

In the molded surface fastener of Patent Document 4, since a plurality of surface fastener members are connected with each other by a thin monofilament, the surface fastener member tends to twist with respect to an adjacent surface fastener member, and it needs to adjust directions of the surface fastener members when the molded surface fastener is attached to a molding die, in some cases.

Patent Document 4 also discloses an Embodiment in which a plurality of surface fastener members are connected with each other by connecting portions formed thinner than the substrate portion, without using the monofilament (see Embodiment 2 in Patent Document 4). In the case of the molded surface fastener regarding the Embodiment without using the monofilament, however, strength of the connecting portion is lower than that of the monofilament, and it may be cut at the connecting portion.

Further, in a case of molding a molded surface fastener using a die wheel in which a cavity space for engaging elements and the like is recessed on a periphery, when the cooled and solidified molded surface fastener is peeled off from the die wheel, engaging elements are not provided on a part in which the connecting portion is formed, therefore the part can be easily peeled off with a small resistance force from the die wheel. On the other hand, however, since the peeling resistance of the part in which the connecting portion is formed is small, peeling force of the molded surface fastener becomes uneven in the length direction of the molded surface fastener. Due to the above, the hook-shaped engaging elements disposed close to the part in which the connecting portion is formed receive a large force when the molded surface fastener is peeled off from the die wheel, and a shape of the engaging elements may be affected such as a deformation of the engaging elements and the like.

In the molded surface fastener described in Patent Document 5, although a plurality of fastening segments are connected with each other along the length direction by flexible neck portions, there have been problems that it is difficult to secure appropriate strength of the connecting portion, and the molded surface fastener tends to be cut at the neck portion. Further, since the neck portion of the molded surface fastener of Patent Document 5 is also narrowly formed, a surface fastener member tends to twist with respect to an adjacent surface fastener member.

In manufacturing the molded surface fastener of Patent Document 5, a molded surface fastener without having a neck portion is molded as a primary product using a die wheel, and a cutting processing is performed to the molded surface fastener as the primary product, for example. When the cutting processing for the molded surface fastener as the primary product is performed, a position of the molded surface fastener as the primary product is detected by inserting a positioning member between the engaging elements, and the molded surface fastener is pressed with the positioning member.

In a case of the molded surface fastener of Patent Document 5, however, an interval between respective engaging elements is small, and the engaging elements are disposed to be staggered. Therefore, it is difficult to insert the positioning member between the engaging elements, which results in lowered operational efficiency at the cutting processing, and deformation or breakage of the engaging elements due to a contact of the positioning member with the engaging elements.

The present invention has been made in view of the problems of the above conventional technique, and a specific object of the invention is to provide a molded surface fastener made of thermoplastic resin which can be easily applicable to a curve-shaped usage which is bent in the width direction, and can be manufactured efficiently by preventing occurrence of deformation or breakage of the engaging elements, and to provide a method for manufacturing the molded surface fastener.

Means for Solving the Problems

In order to achieve the above object, a molded surface fastener provided by the present invention has the below primary feature as a basic structure: a molded surface fastener made of thermoplastic resin which is integrated to a surface of a cushion body when the cushion body is foamed and molded, including engaging regions in which a plurality of hook-shaped engaging elements stand on a first surface of a thin plate-shaped substrate portion and space regions having a flat surface in which the engaging elements are excluded on the substrate portion alternately in a length direction, the engaging region has a pair of left and right resin intrusion barrier portions standing along the length direction at left and right side edge portions of the substrate portion and main lateral wall portions standing along a width direction at a front end edge portion and a rear end edge portion of the engaging region so as to compart from the space region, being characterized in that the space region has a pair of left and right vertical wall portions standing along the length direction at left and right side edge portions of the substrate portion and a convex rib portion projecting integrally from the substrate portion along the length direction at a center portion in the width direction of the substrate portion, and the convex rib portion is integrally connected to the main lateral wall portions adjacent to the space region in the length direction.

In the molded surface fastener of the present invention, it is preferable that the substrate portion, the resin intrusion barrier portions, the main lateral wall portions, the vertical wall portions and the convex rib portions are configured to use the same thermoplastic resin.

It is also preferable that the resin intrusion barrier portion of the engaging region and the vertical wall portion of the space region are formed as a series of continuous wall portions standing continuously along the length direction on the entire substrate portion.

Further, it is preferable that the engaging region has auxiliary lateral wall portions disposed along the width direction at intermediate positions between the main lateral wall portion on a side of the front end edge portion and the main lateral wall portion on a side of the rear end edge portion.

According to the present invention, a molded surface fastener which can be bent in the width direction is provided by using the molded surface fastener having the above structure as a primary product, the molded surface fastener as the primary product is subjected to a cutting processing to cut off the space region so that at least the convex rib portion is remained, a plurality of surface fastener members having front and rear cut end portions formed by the cutting processing and a plurality of the engaging elements are connected in the length direction by flexible connecting portions including the convex rib portion.

A method for manufacturing the molded surface fastener according to the present invention has the below primary feature: the method in which a plurality of surface fastener members in which a plurality of hook-shaped engaging elements stand on a first surface of a substrate portion are connected in a length direction by flexible connecting portions, and which can be integrated to a surface of a cushion body in a bent state in the width direction when the cushion body is foamed and molded, wherein the method includes molding a molded surface fastener as a primary product using a die wheel in which a cavity space is formed on a periphery, in which the substrate portion has engaging regions in which a plurality of the engaging elements stand on the substrate portion and space regions having a flat surface in which the engaging elements are excluded on the substrate portion alternately in the length direction, the engaging region has a pair of left and right resin intrusion barrier portions standing along the length direction at left and right side edge portions of the substrate portion and main lateral wall portions standing along the width direction continuously between the left and right resin intrusion barrier portions at both end edge portions in the length direction of the engaging region so as to compart from the space region, and the space region has a pair of left and right vertical wall portions standing along the length direction at left and right side edge portions of the substrate portion and a convex rib portion projecting integrally from the substrate portion along the length direction at a center portion in the width direction of the substrate portion, peeling off the molded surface fastener as the primary product from the die wheel, detecting a position of the molded surface fastener by inserting a positioning member to the space region in the molded surface fastener as the primary product and performing a cutting processing to the molded surface fastener whose position is detected to cut off the space region so that at least the convex rib portion is remained.

The method for manufacturing the molded surface fastener according to the present invention preferably includes inserting the positioning member to the space region by intermittently stopping the conveyed molded surface fastener when detecting a position of the molded surface fastener as the primary product and performing the cutting processing to the stopped molded surface fastener by moving up and down a cutting punch having a tip cutting blade portion sloped outward from a center portion in the width direction of the substrate portion at a predetermined position.

The method for manufacturing the molded surface fastener according to the present invention may also include conveying continuously the molded surface fastener as the primary product and inserting the positioning member to the space region while moving along the conveying direction of the molded surface fastener when detecting the position of the molded surface fastener, and performing the cutting processing to the continuously conveyed molded surface fastener by moving up and down the cutting punch having the tip cutting blade portion sloped outward from a center portion in the width direction of the substrate portion while moving along the conveying direction.

Further, the method for manufacturing the molded surface fastener according to the present invention may include, when detecting a position of the molded surface fastener, conveying the molded surface fastener continuously and inserting the positioning member to the space region by rotating a positioning roller on which the positioning members are disposed on the periphery corresponding to a conveying rate of the molded surface fastener, and performing the cutting processing to the continuously conveyed molded surface fastener by rotating a rotary die on which the cutting blade portion is disposed on the periphery corresponding to the conveying rate of the molded surface fastener.

Effects of the Invention

The molded surface fastener according to the invention includes engaging regions having a plurality of engaging elements and space regions having a flat surface on which the engaging elements are excluded on the substrate portion alternately in the length direction. The engaging region has a pair of left and right resin intrusion barrier portions standing along the length direction and main lateral wall portions standing along the width direction so as to compart from the space region. The space region has a pair of left and right vertical wall portions standing along the length direction at left and right side edge portions of the substrate portion and a convex rib portion projecting integrally from the substrate portion along the length direction at a center portion in the width direction of the substrate portion, and the convex rib portion is integrally connected to the main lateral wall portion adjacent in the length direction of the space region.

For such a molded surface fastener of the present invention, a plurality of surface fastener members can be provided with a shape connected with each other by flexible connecting portions including the convex rib portion by performing an easy cutting processing to cut off the space region so that at least the convex rib portion is remained. Therefore, it can easily correspond to a curve-shaped usage bending in the width direction without using other members such as polystyrene foam or a nonwoven fabric as in the above mentioned Patent Document 3 or a monofilament as in Patent Document 4.

Further, in this case, a strength of the connecting portion can be enhanced because the convex rib portion forming the connecting portion is formed to project integrally from the substrate portion and integrally connected to the main lateral wall portion of the engaging region adjacent frontward or backward. In addition, a relative position relation between the convex rib portion and the substrate portion or the main lateral wall portion can be stably maintained, thereby a twist between the surface fastener members connected by the connecting portion hardly occurs.

Also in the present invention, when the molded surface fastener is molded using a die wheel in which a cavity space for engaging elements and the like is recessed on the periphery, a pair of left and right vertical wall portions and the convex rib portion are disposed on the substrate portion in the space region. The pair of left and right vertical wall portions disposed in the space region become rather encumbrance at the time of cutting processing to correspond to the curve-shaped usage, as described later. However, since the pair of left and right vertical wall portions and the convex rib portion are disposed in the space region, a peeling resistance to peel off the part of the space region from the die wheel can be increased, and non-evenness of the peeling force of the molded surface fastener in the length direction of the molded surface fastener can be suppressed. Thereby, the engaging elements arranged close to the space region hardly receive a large force when the molded surface fastener is peeled off from the die wheel, and the molded surface fastener having a predetermined shape can be stably formed.

Further, in the present invention, the engaging region having a plurality of the engaging elements and the space region without the engaging elements are disposed alternately in the length direction. Therefore, when the above mentioned cutting processing is performed to correspond to a curve-shaped usage, for example, the positioning member detecting a position of the molded surface fastener can be stably inserted into the space region of the molded surface fastener, and the position of the molded surface fastener can be precisely and promptly detected. Therefore, the cutting processing can be performed accurately and efficiently. Also, since the engaging elements are not disposed on the space region, insertion of the positioning member into the space region does not lead to deformation or breakage of the engaging elements in the engaging region.

In the molded surface fastener of the present invention, the substrate portion, the resin intrusion barrier portion, the main lateral wall portion, the vertical wall portion and the convex rib portion are formed using the same thermoplastic resin. Thereby respective portions of the molded surface fastener can be formed integrally and firmly, the molding process can be prevented from being complexed, and the molded surface fastener can be manufactured efficiently.

Since the molded surface fastener is formed using the same thermoplastic resin, when the molded surface fastener is corresponded to a bent-shape usage by performing the above mentioned cutting processing, for example, a relative position relation between the convex rib portion and the substrate portion or the main lateral wall portion can be more stably maintained, thereby a twist occurs more unlikely between the surface fastener members connected by the connecting portion.

In this case, since magnetic particles are mixed in or coated on at least a part of the substrate portion in the width direction, magnetic property can be applied to the molded surface fastener. Thereby, when a cushion body is foamed and molded using a molding die in which a magnet is disposed on or close to a cavity surface, the molded surface fastener can be attracted and fixed to the cavity surface of the molding die easily and stably by using a magnetic attractive force between the magnet of the molding die and the molded surface fastener. Further, since the magnetic particles are contained in the substrate portion along the length direction, a self-alignment effect can be obtained in which the molded surface fastener can be automatically and precisely adjusted to a predetermined position of the molding die.

In the molded surface fastener of the present invention, the resin intrusion barrier portions of the engaging region and the vertical wall portion of the space region are formed to be a series of a continuous wall portion standing continuously on the whole substrate portion along the length direction. Therefore, when the molded surface fastener is molded using a die wheel on which a cavity space for the engaging elements and the like are recessed on the periphery, the resin intrusion barrier portions of the engaging region and the vertical wall portion of the space region can be stably molded to a predetermined shape. When the molded surface fastener is peeled off from the die wheel, occurrence of uneven peeling force of the molded surface fastener in the length direction of the molded surface fastener can be suppressed. In the present invention, the resin intrusion barrier portions of the engaging region and the vertical wall portion of the space region can stand separately at different positions of the substrate portion in the width direction.

In addition, in the molded surface fastener of the present invention, the engaging region has an auxiliary lateral wall portion disposed along the width direction at an intermediate position between the main lateral wall portion on a side of the front end edge portion and the main lateral wall portion on a side of the rear end edge portion. Therefore, for example, when the substrate portion of the molded surface fastener is cut not at the space region but at a part of the engaging region in order to obtain a desired length of the molded surface fastener, the above-mentioned auxiliary lateral wall portion can be used as the resin intrusion barrier portion which prevent the foam resin material from intruding from the length direction. Thereby, in the cushion body which the molded surface fastener is integrated to, the cut whole engaging region is prevented from being buried in the cushion body, and the engaging force by the engaging elements can be obtained close to the cut end portion of the engaging region.

Further, according to the present invention, a molded surface fastener can be obtained, wherein a straight-type molded surface fastener having the above structure is defined as a primary product, the molded surface fastener as the primary product is subjected to a cutting processing to cut off the space region so that at least the convex rib portion is remained, and a plurality of surface fastener members having front and rear cut end portions formed by the cutting processing and a plurality of engaging elements are connected in the length direction by flexible connecting portions including the convex rib portion.

The molded surface fastener obtained by performing the cutting processing to the straight-type molded surface fastener as the primary product can be manufactured without performing a different molding process from that of the straight-type molded surface fastener, which can realize improved efficiency of the manufacturing process and reduction of the manufacturing cost.

Since the convex rib portion forming the connecting portion is formed to protrude integrally from the substrate portion, and to be integrally connected to the main lateral wall portions of adjacent front and rear engaging regions, strength of the connecting portion can be enhanced. In addition, since a relative position relation between the convex rib portion and the substrate portion or the main lateral wall portion can be stably maintained, a twist between the surface fastener members connected by the connecting portion hardly occurs.

In a method for manufacturing a molded surface fastener provided by the present invention, first, a molded surface fastener as a primary product is manufactured using a die wheel on which a cavity space is formed on the periphery. Here, the molded surface fastener is formed such that an engaging region on which a plurality of engaging elements stand on a tape-shaped substrate portion and a space region having a flat surface on which the engaging elements are excluded are alternately disposed in the length direction, the engaging region has a pair of left and right resin intrusion barrier portions and front and rear main lateral wall portions, and the space region has a pair of left and right vertical wall portions and the convex rib portion.

Subsequently, the molded surface fastener as the primary product formed around the die wheel is peeled off from the die wheel. At this time, since the pair of left and right vertical wall portions and the convex rib portion are disposed on the substrate portion of the space region in the molded surface fastener, peeling resistance when a part of the space region is peeled off from the die wheel can be increased. Therefore, uneven peeling force of the molded surface fastener in the length direction of the molded surface fastener can be suppressed. Thereby, the engaging elements disposed close to the space region hardly receive a large force when the molded surface fastener is peeled off from the die wheel, which enables to form engaging elements having a predetermined shape stably.

After peeling off the molded surface fastener as the primary product from the die wheel, a position of the molded surface fastener is detected by inserting a positioning member to the space region in the molded surface fastener as the primary product. In this case, in the present invention, the positioning member can be stably inserted to the space region of the molded surface fastener, and a position of the molded surface fastener can be precisely and promptly detected. In addition, since an engaging element is not disposed in the space region, when the positioning member is inserted to the space region, deformation or breakage of the engaging element in the engaging region are not occurred.

And in the manufacturing method of the present invention, a cutting processing is performed to cut off the space region so that at least the convex rib portion is remained in the molded surface fastener whose position is detected by inserting the positioning member, thereby a plurality of surface fastener members having a plurality of engaging elements are connected in the length direction by the flexible connecting portion including the convex rib portion, and the molded surface fastener which can bend in the width direction at the connecting portion can be stably and efficiently manufactured.

In the manufacturing method of the molded surface fastener according to the present invention, a position of the molded surface fastener can be more precisely and stably detected by stopping the conveyed molded surface fastener intermittently and inserting the positioning member to the space region when the position of the molded surface fastener as the primary product is detected.

Further, by performing the cutting processing to the stopped molded surface fastener by moving up and down a cutting punch having a tip cutting blade portion which is sloped outward from a center portion of the width direction in the substrate portion, a predetermined part of the space region in the molded surface fastener can be tidily and surely cut off, and a cut end portion formed by the cutting processing (cut edge) is finished tidily. In addition, the connecting portion having the convex rib portion can be formed stably to have a predetermined shape and dimension.

In the molded surface fastener according to the present invention, when detecting a position of the molded surface fastener as the primary product, the molded surface fastener may be conveyed continuously, and the positioning member may be inserted to the space region while being moved along the conveying direction of the molded surface fastener. Thereby, the position of the molded surface fastener can be efficiently detected while the molded surface fastener is conveyed.

In this case, the cutting processing can be performed to the molded surface fastener conveyed continuously by moving up and down the cutting punch having a tip cutting blade portion sloped outward from the center portion in the width direction in the substrate portion while moving along the conveying direction, thereby a predetermined part of the space region in the molded surface fastener can be efficiently cut off, and the cut surface (cut edge) formed by the cutting processing can be finished tidily. Further, the connecting portion having the convex rib portion can be formed stably to have a predetermined shape and dimension.

Further, in the manufacturing method of the molded surface fastener according to the present invention, when detecting a position of the molded surface fastener as the primary product, the positioning member may be inserted to the space region by conveying the molded surface fastener continuously and rotating a positioning roller on which the positioning member is disposed on the periphery in accordance with the conveying rate of the molded surface fastener. Thereby, a position of the molded surface fastener can be efficiently detected while the molded surface fastener is conveyed.

In this case, also, the cutting processing can be performed to the molded surface fastener conveyed continuously by rotating a rotary die on which a cutting blade portion is disposed on the periphery in accordance with the conveying rate of the molded surface fastener. Thereby a predetermined part of the space region in the molded surface fastener can be efficiently cut off, and the connecting portion having the convex rib portion can be stably formed to have a predetermined shape and dimension.

MODES FOR CARRYING OUT THE INVENTION

Hereinafter, modes for carrying out the invention will be described in detail showing embodiments with reference to the drawings. Please note that the present invention is not limited to the embodiments explained as below, and various changes can be made as long as having a substantially same structure and similar functional effects. For example, a number of hook-shaped engaging elements disposed on a surface fastener portion, a position to be disposed and a pitch to be attached are not limited, and can be changed randomly.

Embodiment 1

Figure 1:
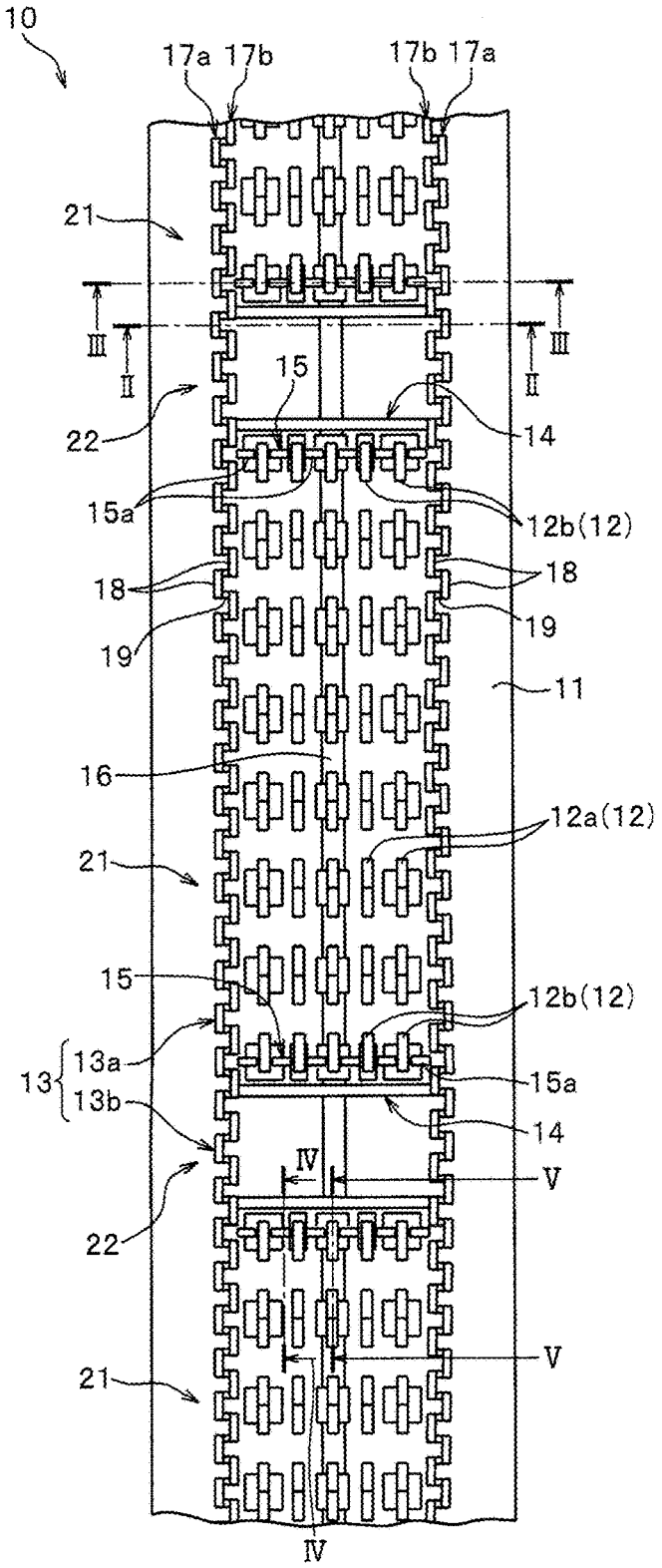
FIG. 1 is a plan view illustrating a molded surface fastener according to Embodiment 1 of the present invention.
Figure 2:
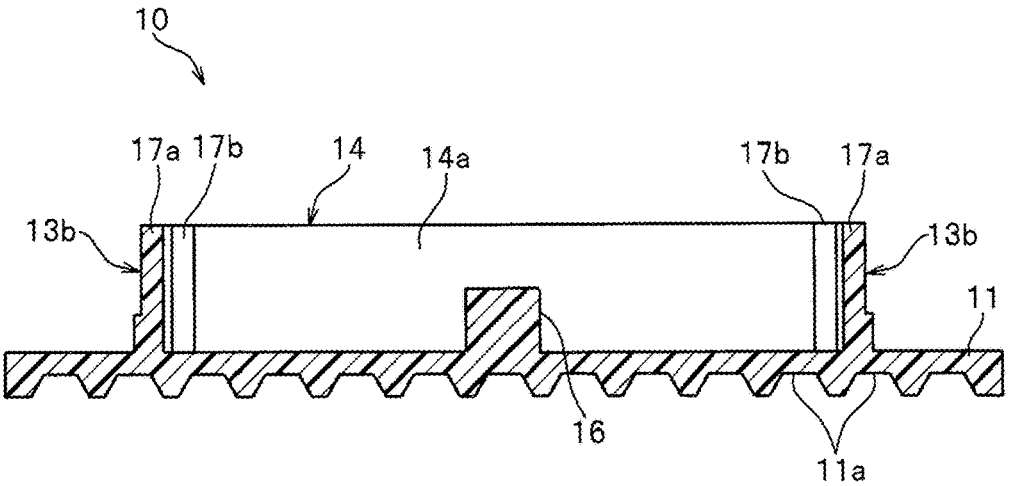
FIG. 2 is a cross-sectional view along the line II-II of FIG. 1.

FIG. 1 is a plan view illustrating a molded surface fastener according to Embodiment 1, and FIG. 2 to FIG. 5 are cross-sectional views along the lines II-II to V-V, respectively, in FIG. 1.

In the following descriptions, a longitudinal direction of the substrate portion in the molded surface fastener is defined as a front and rear direction, and a width direction of the substrate portion is defined as a left and right direction. A top and bottom direction of the substrate portion is defined as a vertical direction, and particularly, a direction in which engaging elements are disposed with respect to the substrate portion is referred to as "upper", and an opposite direction is referred to as "lower".

A molded surface fastener 10 according to Embodiment 1 is formed to be long in the length direction by molding a thermoplastic resin material using a die wheel 41, as described later. A material of the molded surface fastener 10 is not limited, and a single thermoplastic resin material such as polyethylene, polypropylene, polyester, nylon, polybutylene terephthalate, or copolymer thereof can be adopted as the material of the molded surface fastener 10.

The molded surface fastener 10 according to Embodiment 1 has a thin plate-shaped substrate portion 11. In the substrate portion 11, an engaging region 21 on which a plurality of hook-shaped engaging elements 12 stand on an upper surface (first surface) and a space region 22 having a flat surface on which the engaging elements 12 are excluded are alternately disposed in the length direction. Respective engaging regions 21 are formed to have predetermined intervals in the length direction.

In Embodiment 1, the hook-shaped engaging element 12 has a hook-shaped first engaging element 12*a* in which an engaging head is branched to two parts and exerts a main engaging force of the engaging region 21, as described later, and a hook-shaped second engaging element 12*b* forming an auxiliary lateral wall portion 15 together with a divided lateral wall body 15*a*, as described later.

Please note in Embodiment 1, the engaging region 21 means a region on which the first and the second engaging elements 12*a*, 12*b* exerting an engaging force when integrated to a surface of a cushion body are disposed, and this engaging region 21 has a forming region of the engaging elements which is surrounded by a pair of resin intrusion barrier portions 13*a* and front and rear main lateral wall portions 14, as described later, and a plurality of the first and the second engaging elements 12*a*, 12*b* stand on. The space region 22 is a region which is comparted from the engaging region 21 by the main lateral wall portions 14, and is formed to be a state without a part functioning as the engaging elements 12 when integrated to a surface of the cushion body (a state that the engaging elements 12 are excluded).

A length dimension of the space region 22 (dimension in the length direction) is not particularly limited, and the length dimension of the space region 22 in Embodiment 1 is set to be smaller than the length dimension of the engaging region 21 in order to obtain the engaging force by the first and the second engaging elements 12*a*, 12*b* in the engaging region 21 of the molded surface fastener 10 appropriately.

Also when a curve-applicable molded surface fastener 30 which can bend in the width direction, as described later, is manufactured by cutting off a part of the space region 22 by performing a cutting processing to a straight-shaped molded surface fastener 10 (primary product) as shown in FIG. 1, the length dimension of the space region 22 is preferably set to a dimension enabling to bend the curve-applicable molded surface fastener 30 which can bend to appropriate curvature. For example, it is preferable that the dimension is set to be larger than the size of the attaching pitch in the length direction of the first engaging element 12*a*, for example (an interval between the adjacent first engaging elements 12*a* in the length direction).

In each engaging region 21 of the molded surface fastener 10 in Embodiment 1, a pair of left and right resin intrusion barrier portions 13*a* standing along the length direction at left and right side edge portions of the substrate portion 11 so as to interpose a plurality of engaging elements 12 between them, front and rear main lateral wall portions 14 standing along the width direction at a front end edge portion and a rear end edge portion of each engaging region 21 so as to be comparted from the space region 22, subsidiary lateral wall portions 15 disposed inside of and adjacent to the front and rear main lateral wall portions 14 and a convex rib portion 16 integrally projecting from the substrate portion 11 along the length direction at a center portion in the width direction of the substrate portion 11.

Meanwhile, in each space region 22 of the molded surface fastener 10, a pair of left and right vertical wall portions 13*b* standing along the length direction at left and right side edge portions of the substrate portion 11 and a convex rib portion 16 integrally projecting from the substrate portion 11 along the length direction at a center portion in the width direction of the substrate portion 11.

In this case, the resin intrusion barrier portions 13*a* of the engaging region 21 and the vertical wall portions 13*b* of the space region 22 are formed as a series of continuous wall portions 13 standing continuously along the length direction of the whole substrate portion 11. The convex rib portion 16 of the engaging region 21 and the convex rib portion 16 of the space region 22 are disposed to continue along the length direction. Please note that in the present invention, the molded surface fastener 10 can be formed to remove the convex rib portion 16 from the engaging region 21. Hereinafter, structures of respective portions of the molded surface fastener 10 in Embodiment 1 will be specifically explained.

The substrate portion 11 of the molded surface fastener 10 has a thin plate shape which is a rectangular shape, long in the front and rear direction (length direction) and narrow in the left and right direction (width direction) when viewed from the vertical direction (top and bottom direction), and is configured to be able to bend in the vertical direction. At left and right side edge portions of the substrate portion 11, the above mentioned continuous wall portions 13 are disposed in a position inside of the left and right side edges of the substrate portion 11, and an upper surface of outside of the continuous wall portion 13 is formed as a flat surface.

A plurality of concave groove portions 11*a* are provided parallel to the front and rear direction on a side of a lower surface (bottom surface) of the substrate portion 11. Since the substrate portion 11 has such a plurality of concave groove portions 11*a*, when the molded surface fastener 10 is integrated to a cushion body (foam body) when the cushion body is foamed and molded, fixing strength of the molded surface fastener 10 with respect to the cushion body can be enhanced by a large contact area between the molded surface fastener 10 and the cushion body.

In order to enhance the fixing strength of the molded surface fastener 10 with respect to the cushion body in the present invention, a convex rib portion or an arrowhead-shaped protrusion portion may be provided, or nonwoven fabric may be bonded on the lower surface of the substrate portion 11, for example, instead of a plurality of the concave groove portions 11*a*, as mentioned above. Alternately, the lower surface of the substrate portion 11 may be formed as a flat surface without the concave groove portion 11*a* and the like, as mentioned above.

In each engaging region 21 provided on the substrate portion 11, a plurality of first engaging elements 12*a* and a plurality of second engaging elements 12*b* stand within a region surrounded by the left and right resin intrusion barrier portions 13*a* and the front and rear main lateral wall portions 14 (a forming region of the engaging elements).

The first engaging elements 12*a* stand on the upper surface of the substrate portion 11 lining at predetermined attaching pitches in the length direction and the width direction so as to obtain adequate engaging force with a skin material covering the cushion body. Particularly, the first engaging elements 12*a* of each engaging region 21 in Embodiment 1 line in five rows in the length direction (longitudinal direction) between the left and right resin intrusion barrier portions 13*a* and line in six rows in the width direction (lateral direction) between the front and rear main lateral wall portions 14.

Further, each first engaging element 12*a* has a rising portion standing vertically from the upper surface of the substrate portion 11 and a hook-shaped engaging head portion branching in the front and rear direction from the upper end portion of the rising portion and bending. A height dimension of each first engaging element 12*a* from the upper surface of the substrate portion 11 (a dimension in a height direction) is set as the same size as height dimensions of a vertical wall body 18 of the resin intrusion barrier portion 13*a*, as described later, the main lateral wall portion 14 (continuous lateral wall body 14*a*) and a divided lateral wall body 15*a* of a subsidiary lateral wall portion 15, as described later.

It should be noted that a shape, a dimension and an attaching pitch and the like of the first engaging element 12*a* are not particularly limited, and can be changed randomly. In the first engaging elements 12*a* disposed at the first, the third and the fifth longitudinal rows from the left resin intrusion barrier portion 13*a*, reinforcement portions which reinforce the first engaging elements are provided integrally at left and right side surfaces of the rising portions.

Each second engaging element 12*b* has a rising portion standing vertically from the upper surface of the substrate portion 11 and a cantilever-shaped engaging head portion which bends in a hook shape from the upper end portion of the rising portion toward a side of a forming region of the first engaging element 12*a* (inside of each engaging region 21 in the length direction). In each second engaging element 12*b*, reinforcement portions which reinforce the second engaging element 12*b* are provided integrally at the rising portion. In Embodiment 1, an interval between the second engaging element 12*b* and the first engaging element 12*a* in the length direction is almost as the same size as the attaching pitch of the first engaging elements 12*a* in the length direction.

The left and right continuous wall portions 13 (i.e. the resin intrusion barrier portions 13*a* of the engaging region 21 and the vertical wall portions 13*b* of the space region 22) in Embodiment 1 have a first continuous vertical wall portion (first continuous vertical wall row) 17*a* disposed on an outer side in the width direction and the second continuous vertical wall portion (second continuous vertical wall row) 17*b* disposed inside of the first continuous vertical wall portion 17*a*, respectively. The first and the second continuous vertical wall portions 17*a*, 17*b* are formed of a plurality of vertical wall bodies 18 disposed intermittently lining in a row along the length direction, respectively. It should be noted that in the present invention, the number of continuous vertical wall rows forming the continuous wall portion 13 (number of rows) and a shape of the vertical wall body 18 are not particularly limited.

In Embodiment 1, the vertical wall body 18 forming the first and the second continuous vertical wall portions 17*a*, 17*b* are respectively disposed intermittently along the front and rear direction at predetermined attaching pitches, and predetermined gaps are provided between adjacent respective vertical wall bodies 18 in the length direction. The vertical wall body 18 of the first continuous vertical wall portion 17*a* and the vertical wall body 18 of the second continuous vertical wall portion 17*b* are alternately disposed to be a staggered position in the length direction.

In addition, a front end portion of the vertical body 18 of the first continuous vertical wall portion 17*a* and a rear end portion of the vertical wall body 18 of the second continuous vertical wall portion 17*b* are connected with each other by a wall connecting portion 19, and a rear end portion of the vertical wall portion 18 of the first continuous vertical wall portion 17*a* and a front end portion of the vertical wall body 18 of the second continuous vertical wall portion 17*b* are connected with each other by another wall connecting portion 19. In this case, the vertical wall body 18 of the first continuous vertical wall portion 17*a*, the vertical wall body 18 of the second continuous vertical wall portion 17*b* and the wall connecting portion 19 is formed to have the same height dimensions from the upper surface of the substrate portion 11.

Since the left and right continuous wall portions 13 have the above structure, the foam resin material can be prevented from intruding in the forming region (i.e. a region between the left and right resin intrusion barrier portions 13*a* in the engaging region 21) of the first and the second engaging elements 12*a*, 12*b* over the continuous wall portion 13 when the cushion body is foamed and molded.

Further, the left and right continuous wall portions 13 are disposed in the whole length direction of the substrate portion 11, and the molded surface fastener 10 can be bent in the vertical direction by spreading or narrowing the gaps between the vertical wall bodies 18 of the first and the second continuous vertical wall portions 17*a*, 17*b*. Thereby, flexibility of the molded surface can be prevented from interfering by the provision of the left and right continuous wall portions 13.

In addition, since the left and right continuous wall portions 13 are formed as the above, when the molded surface fastener 10 of Embodiment 1 is molded using a die wheel 41, as described later, the obtained molded surface fastener 10 can be prevented from rolling back to a side of the upper surface of the substrate portion 11 on which the left and right continuous wall portions 13 are provided.

The main lateral wall portions 14 in Embodiment 1 stand integrally from the upper surface at the front end edge portion and the rear end edge portion of the engaging region 21 in the substrate portion 11, and are formed of continuous lateral wall bodies 14*a* continuously disposed along the width direction entirely between the left and right resin intrusion barrier portions 13*a*. The continuous lateral wall bodies 14*a* are disposed linearly with a constant height dimension from the substrate portion 11 and are connected to the left and right resin intrusion barrier portions 13*a*.

The main lateral wall portion 14 and the subsidiary lateral wall portion 15 adjacent to a side of the forming region of the first engaging elements 12*a* of the main lateral wall portion 14 are disposed in parallel with each other at a distance, and a distance between the continuous lateral wall body 14*a* of the main lateral wall portion 14 and a subsidiary lateral wall body, as described later, of the subsidiary lateral wall portion 15 is set to be smaller than a size of the attaching pitch of the first engaging elements in the length direction.

This leads to an increased forming density of the first engaging elements 12*a* in the length direction of the molded surface fastener 10, and an entire engaging force which the molded surface fastener 10 has can be enhanced. Further, the substrate portion 11 of the molded surface fastener 10 can be prevented from bending to roll back in the width direction.

Figure 3:
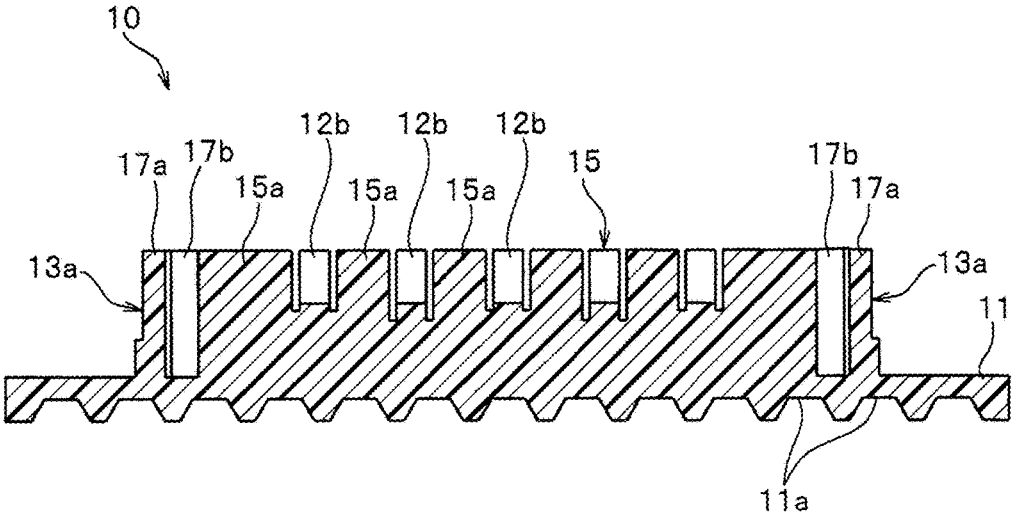
FIG. 3 is a cross-sectional view along the line of FIG. 1.
Figure 4:
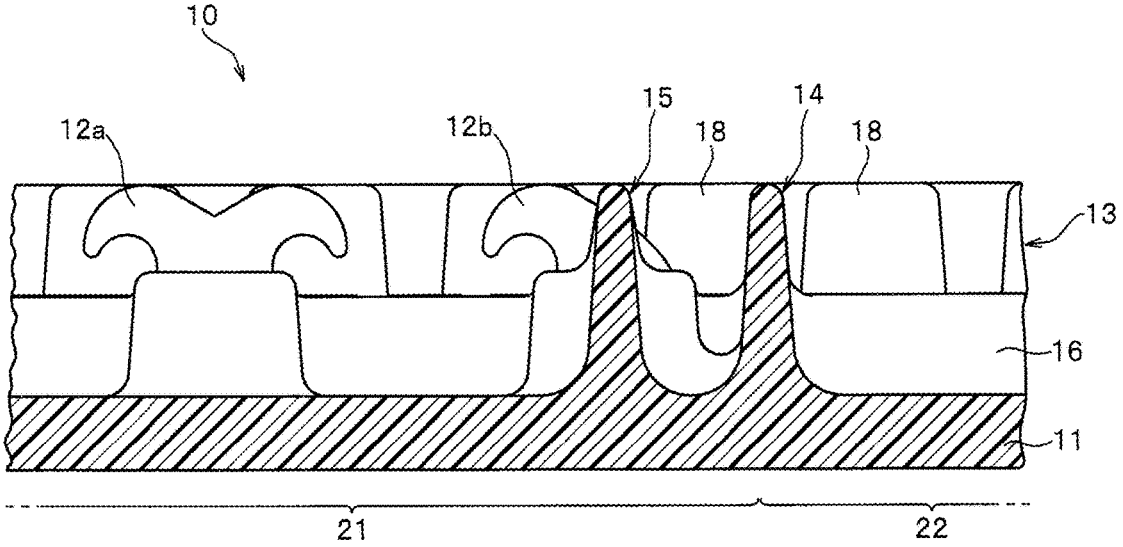
FIG. 4 is a cross-sectional view along the line IV-IV of FIG. 1.
Figure 5:
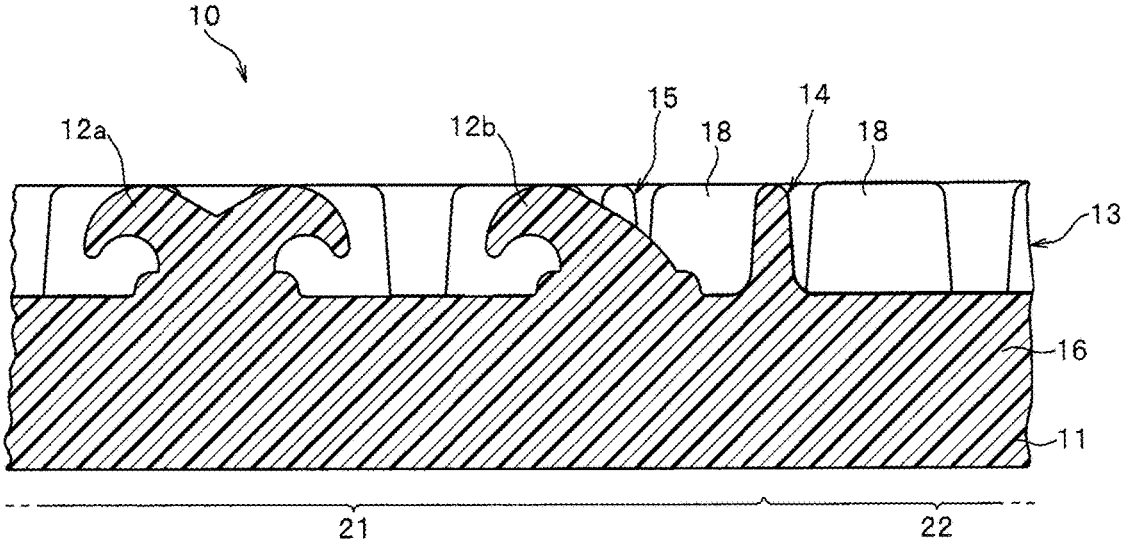
FIG. 5 is a cross-sectional view along the line V-V of FIG. 1.

The subsidiary lateral wall portion 15 of Embodiment 1 has, as shown in FIG. 3, a plurality of divided lateral wall bodies 15*a* standing intermittently along the width direction with a constant height dimension from the upper surface of the substrate portion 11 between the left and right resin intrusion barrier portions 13*a* and a plurality of second engaging elements 12*b* disposed between respective divided lateral wall bodies 15*a*.

Particularly, the subsidiary lateral wall portion 15 of Embodiment 1 is formed of six divided lateral wall bodies 15*a* lining linearly along the width direction and five second engaging elements 12*b* standing between the divided lateral wall bodies 15*a*. In the present invention, the subsidiary lateral wall portion 15 may be formed of continuous lateral wall bodies continuously disposed along the width direction entirely between the left and right resin intrusion barrier portions 13*a*.

In this case, each divided lateral wall body 15*a* stands on the upper surface of the substrate portion 11 to have a rectangular parallelepiped shape, and the divided lateral wall body 15*a* and the second engaging element 12*b* adjacently disposed each other are connected with each other at a lower end portion on a side of the substrate portion 11. Thereby, the divided lateral wall bodies 15*a* and the second engaging elements 12*b* are reinforced each other, which enhances strength of the divided lateral wall bodies 15*a* and the second engaging elements 12*b*.

Meanwhile, an upper end portion of the divided lateral wall body 15*a* and an upper end portion of the second engaging element 12*b* adjacently disposed each other are formed to have a distance so as to have a small gap between them. Therefore, the engaging head portion of the second engaging element 12*b* has freedom of movement, and when the molded surface fastener 10 is molded using the die wheel 41, as described later, the second engaging elements 12*b* can be pulled out easily from the cavity space of the die wheel 41 to stably form the second engaging elements 12*b* having a predetermined shape. Although the subsidiary lateral wall portion 15 is formed to have a distance from the left and right resin intrusion barrier portions 13*a*, it may be formed to connect with the resin intrusion wall portions 13*a*, depending on a position of the subsidiary lateral wall portion 15.

In the subsidiary lateral wall portion 15, a height dimension of the divided lateral wall body 15*a* from the upper surface of the substrate portion 11 and a height dimension of the second engaging element 12*b* from the upper surface of the substrate portion 11 are set to be the same size as each other, and are set to be the same size as the sizes of the vertical wall bodies 18 of the first and second continuous vertical wall portions 17*a*, 17*b* forming the resin intrusion barrier portions 13*a*, the first engaging elements 12*a* and the continuous lateral wall bodies 14 of the main lateral wall portions 14.

That is, the molded surface fastener 10 of Embodiment 1 is formed so that upper end positions of the left and right intrusion barrier portions 13*a*, the first engaging elements 12*a*, the main lateral wall portions 14 and the subsidiary lateral wall portions 15 are formed to be disposed on a single flat surface. Thereby, when the cushion body is foamed and molded using the straight-shaped molded surface fastener 10 of the Embodiment or a curve-applicable molded surface fastener 30 obtained by performing a cutting processing to the straight-shaped molded surface fastener 10, as described later, the upper end surfaces of the left and right resin intrusion barrier portions 13*a* and the upper end surfaces of the main lateral wall portions 14 and the subsidiary lateral wall portions 15 can be closely contacted to a flat cavity surface of the molding die stably. Therefore, the foam resin material can be prevented from intruding into the forming region of engaging elements of the engaging region 21 over the left and right resin intrusion barrier portions 13*a*, the main lateral wall portions 14 and the subsidiary lateral wall portions 15.

The convex rib portion 16 provided in each space region 22 is integrally projected on the upper surface of the substrate portion 11 so that a cross-section perpendicular to the length direction has a rectangular shape. The convex rib portion 16 is disposed in the entire length direction of the space region 22, and is connected to the main lateral wall portion 14 (continuous lateral wall bodies 14*a*) disposed adjacent to the front and rear of the space region 22.

In the present invention, a height dimension of the convex rib portion 16 from the upper surface of the substrate portion 11 is not particularly limited, but it is preferably 30% or more, more preferably 40% or more of the height dimension of the continuous lateral wall body 14*a* of the main lateral wall portion 14 from the upper surface of the substrate portion 11 in order to secure strength of the connecting portion 32 appropriately when the curve-applicable molded surface fastener 30 is manufactured, as described later.

Considering flexibility and the like of the connecting portion 32 in the curve-applicable molded surface fastener 30, the height dimension of the convex rib portion 16 from the upper surface of the substrate portion 11 is preferably smaller than the height dimension of the continuous lateral wall body 14*a* of the main lateral wall portion 14, particularly preferably at a size of 70% or less of the height dimension of the continuous lateral wall body 14*a*.

In the above-mentioned molded surface fastener 10 of Embodiment 1, magnetic particles made of alloy of iron, cobalt or nickel and the like are mixed in a part of synthetic resin forming the molded surface fastener 10. Particularly, the magnetic particles are mixed in a center portion in the width direction of the substrate portion 11 in the engaging region 21 and the space region 22, and the convex rib portion 16 along the entire length direction in the above-mentioned molded surface fastener 10 of Embodiment 1. A material of the magnetic particles is not particularly limited as long as it is magnetically attracted to a magnet.

Since the magnetic particles are mixed in the molded surface fastener 10, when a magnet is disposed at a fastener holding portion of a molding die used to foam molding of a cushion body, the molded surface fastener 10 can be attracted and fixed stably to the fastener holding portion of the molding die in a predetermined close contact state by using magnetic force between the magnet of the fastener holding portion and the magnetic particles mixed in the molded surface fastener 10.

Further, since the magnetic particles are mixed in the entire length direction of a part of the substrate portion 11 and the convex rib portion 16, as mentioned above, when the molded surface fastener 10 is held at the fastener holding portion of the molding die, self-alignment effect in which a position and a direction of the molded surface fastener 10 with respect to the fastener holding portion of the molding die can be precisely and automatically adjusted is obtained.

In the present invention, as long as the magnetic particles are mixed in at least a part of a region of the molded surface fastener 10 in the entire length direction, a region in which the magnetic particles are mixed in the molded surface fastener 10 can be randomly changed. For example, the magnetic particles can be mixed in the entire length direction and the entire width direction of the molded surface fastener 10.

In addition, in the present invention, instead of mixing the magnetic particles in the synthetic resin forming the molded surface fastener 10, it is possible that after the molded surface fastener 10 is molded to a predetermined shape, the molded surface fastener 10 is formed to be magnetically attracted to a magnet by applying the magnetic particles to a lower surface (bottom surface) of the obtained molded surface fastener 10.

Figure 6:
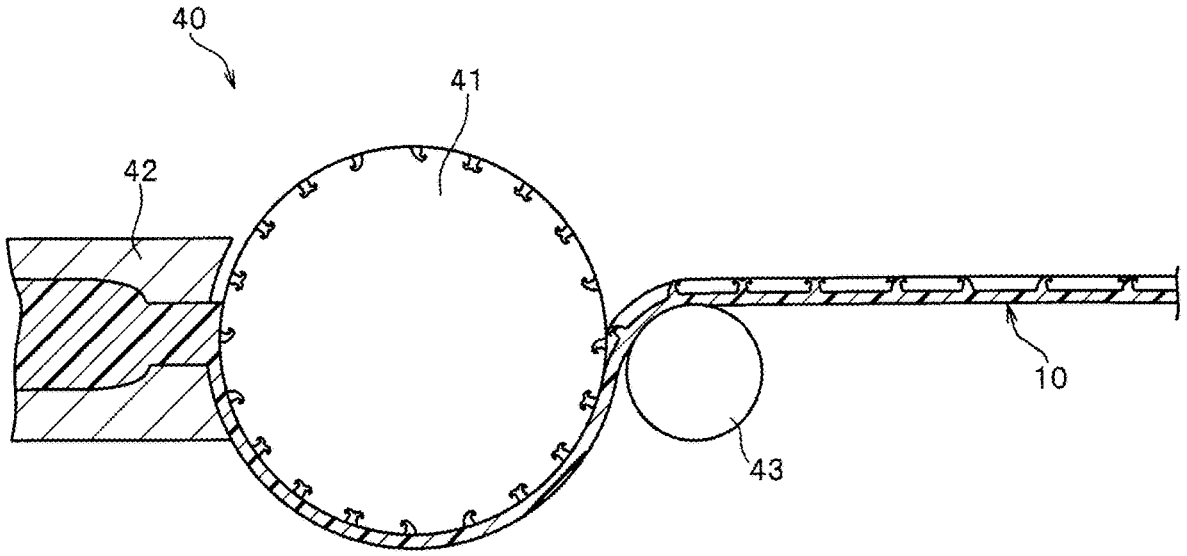
FIG. 6 is a schematic view explaining a molding process of the molded surface fastener.

The molded surface fastener 10 of Embodiment 1 having the above-mentioned structure is manufactured using a manufacturing apparatus (molding apparatus) 40 as shown in FIG. 6, for example.

Specifically, the manufacturing apparatus 40 of the molded surface fastener 10 has a die wheel 41 drive-rotating in one direction, a continuous extrusion nozzle 42 of a molten resin material disposed facing to a periphery of the die wheel 41, a pickup roller 43 disposed facing to the periphery of the die wheel 41 on a downstream side of the continuous extrusion nozzle 41 in the rotating direction of the die wheel 42 and a cut portion which is not shown in the drawings and which a long sheet of the molded surface fastener 10 peeled off from the periphery of the die wheel 41 is cut at a predetermined dimension.

On the periphery of the die wheel 41 which the manufacturing apparatus 40 has, a molding cavity is formed to mold the above-mentioned first and second engaging elements 12*a*, 12*b*, the left and right continuous wall portions 13, the main lateral wall portions 14, the subsidiary lateral wall portions 15 and the convex rib portion 16 of the molded surface fastener 10. The die wheel 41 distributes a coolant in the die wheel 41, and a coolant bath is disposed in a lower portion of the die wheel 41 so as to impregnate a lower half portion of the die wheel 41.

When the molded surface fastener 10 of Embodiment 1 as shown in FIG. 1 is manufactured using such a manufacturing apparatus 40, first, a molten resin material containing a single ingredient or in which magnetic particles are partially mixed is continuously extruded toward the periphery of the die wheel 41 from the continuous extrusion nozzle 42. At this time, the die wheel 41 drivingly rotates in one direction, the molten resin material extruded to the periphery forms a substrate portion 11 of the molded surface fastener 10 between the continuous extrusion nozzle 42 and the die wheel 41, and at the same time, the first and second engaging elements 12*a*, 12*b*, the left and right continuous wall portions 13, the main lateral wall portions 14, the subsidiary lateral wall portions 15 and the convex rib portion 16 are serially formed by the above-mentioned molding cavity.

The molded surface fastener 10 formed on the periphery of the die wheel 41 is solidified by making a half-turn while being supported on the periphery of the die wheel 41 and cooled, and thereafter, peeled off from the periphery of the die wheel 41 continuously by the pickup roller 43.

In this case of the molded surface fastener 10 of Embodiment 1, the engaging region 21 having the first and second engaging elements 12*a*, 12*b* and the space region 22 without having the first and second engaging elements 12*a*, 12*b* are formed alternately in the length direction. Therefore, peeling resistance to peel off from the periphery of the die wheel 41 by the pickup roller 43 is different in the engaging region 21 and the space region 22.

However, in the space region 22 of Embodiment 1, the left and right continuous wall portions 13 (vertical wall portions 13*b*) and the convex rib portion 16 are provided along the length direction. Therefore, the peeling resistance in the space region at the time of peeling off the molded surface fastener 10 from the periphery of the die wheel 41 can be increased, thereby a force to peel off the molded surface fastener 10 can be suppressed from being uneven in the length direction of the molded surface fastener 10.

In a case that the vertical wall portions 13 or the convex rib portion 16 as in Embodiment 1 are not provided in the space region, and the peeling resistance of the space region is significantly smaller than the peeling resistance of the engaging region, for example, the peeling resistance of the engaging region and that of the space region are largely different, and the space region is peeled off from the periphery of the die wheel 41 with a relatively small force. As a result, when the first and second engaging elements disposed close to the space region in the engaging region are pulled out from the cavity space of the die wheel 41, the first and second engaging elements are pulled out aggressively by receiving a large force, and the first and second engaging elements are deformed or damaged, which may affect a shape of the engaging elements.

In Embodiment 1, in contrast, the vertical wall portions 13*b* and the convex rib portion 16 are intentionally provided in the space region 22 in order to increase the peeling resistance of the space region 22 so as to be close to the peeling resistance of the engaging region 21. Thereby, the first engaging elements 12*a* and the second engaging elements 12*b* in the engaging region 21 disposed close to the space region 22 receive a smaller force when pulled out from the cavity space of the die wheel 41. This prevents the first and second engaging elements 12*a*, 12*b* from being deformed or damaged, and the first and second engaging elements 12*a*, 12*b* having a predetermined shape can be stably formed.

Thereafter, the long length of the molded surface fastener 10 peeled off from the die wheel 41 is conveyed to the cutting portion which is not shown in the drawings, and is cut at the cutting portion at a predetermined length. Thus, the straight-shaped molded surface fastener 10, as shown in FIG. 1, having a predetermined length is manufactured. It should be noted that a manufacturing apparatus and a manufacturing method to manufacture the straight-shaped molded surface fastener 10 of the present invention is not particularly limited, and randomly changed.

The straight-shaped molded surface fastener 10 according to Embodiment 1 manufactured by the above-mentioned method is integrated to a cushion body (foam body) such as an automobile seat, for example, at the time the cushion body is foamed and molded.

Specifically, first, the molded surface fastener 10 of Embodiment 1 is placed on a surface fastener attaching surface (surface fastener placing surface) formed at a predetermined position of the cavity surface of a molding die for a cushion body. The surface fastener attaching surface of the molding die is formed as a flat surface. The surface fastener attaching surface may be formed as a convex-shaped or a concave-shaped bent surface in the length direction as long as it is a uniform flat surface in the width direction.

In the molding die, a magnet such as a neodymium magnet is buried corresponding to a position of the surface fastener attaching surface. Therefore, the molded surface fastener 10 is placed on the surface fastener attaching surface of the molding die so as to face to an upper surface of the molded surface fastener 10, thereby the magnetic particles mixed in the molded surface fastener 10 are attracted by the magnetic attracting force of the magnet.

Thereby, the molded surface fastener 10 is attracted and fixed to the surface fastener attaching surface of the molding die, and a position and a direction of the molded surface fastener 10 with respect to the molding die can be precisely and automatically adjusted by the above-mentioned self-alignment effect. In addition, since the molded surface fastener 10 is fixed to the surface fastener attaching surface of the molding die, respective upper surfaces of the left and right continuous wall portions 13, the main lateral wall portions 14 and the subsidiary lateral wall portions 15 of the molded surface fastener 10 are held at the flat surface fastener attaching surface of the molding die in a close contact state.

Consequently, a foam resin material is injected by spraying from an injection nozzle disposed on the molding die into the molding die in which fixes the molded surface fastener 10 is fixed at a predetermined position. At this time, the foam resin material can be injected throughout the cavity space of the molding die by spraying the foam resin material while moving the injection nozzle relatively with respect to the molding die, for example. Further, after a predetermined amount of the foam resin material is injected from the injection nozzle, the molding die is clamped. Thereby, the resin material is foamed and spread throughout the cavity space of the molding die, and a cushion body is molded.

Since the molded surface fastener 10 is positioned and fixed at a predetermined position by an attracting effect of the magnet disposed on the molding die, the position of the molded surface fastener 10 is not moved by flowing pressure or foaming pressure of the foam resin material. Further, since the respective upper surfaces of the left and right continuous wall portions 13, the main lateral wall portions 14 and the subsidiary lateral wall portions 15 of the molded surface fastener 10 are closely contacted with the surface fastener attaching surface of the molding die, the foam resin material can be prevented from intruding into the forming region of the first and second engaging elements 12*a*, 12*b* over the continuous wall portions 13, the main lateral wall portions 14 and the subsidiary lateral wall portions 15.

Then, the foam resin material is foamed and solidified to complete the molding, the cushion body in which the straight-shaped molded surface fastener 10 of Embodiment 1 is integrated can be obtained.

In thus obtained cushion body with the molded surface fastener 10, the first and second engaging elements 12*a*, 12*b* disposed in a region surrounded by the left and right continuous wall portions 13 and the front and rear main lateral wall portions 14 in the engaging region 21 are not buried in the cushion body but are exposed. Therefore, a predetermined engaging force obtained by the first and second engaging elements 12*a*, 12*b* can be stably secured.

Accordingly, by covering a skin material to a surface of the cushion body and pressing the skin material toward the molded surface fastener 10 integrated to the cushion body, loop-shaped engaging elements disposed on a bottom surface of the skin material can be stably engaged with the first and second engaging elements 12*a*, 12*b* of the molded surface fastener 10. Thereby, the skin material can be precisely attached along the surface of the cushion body without lifting up from the cushion body.

Figure 7:
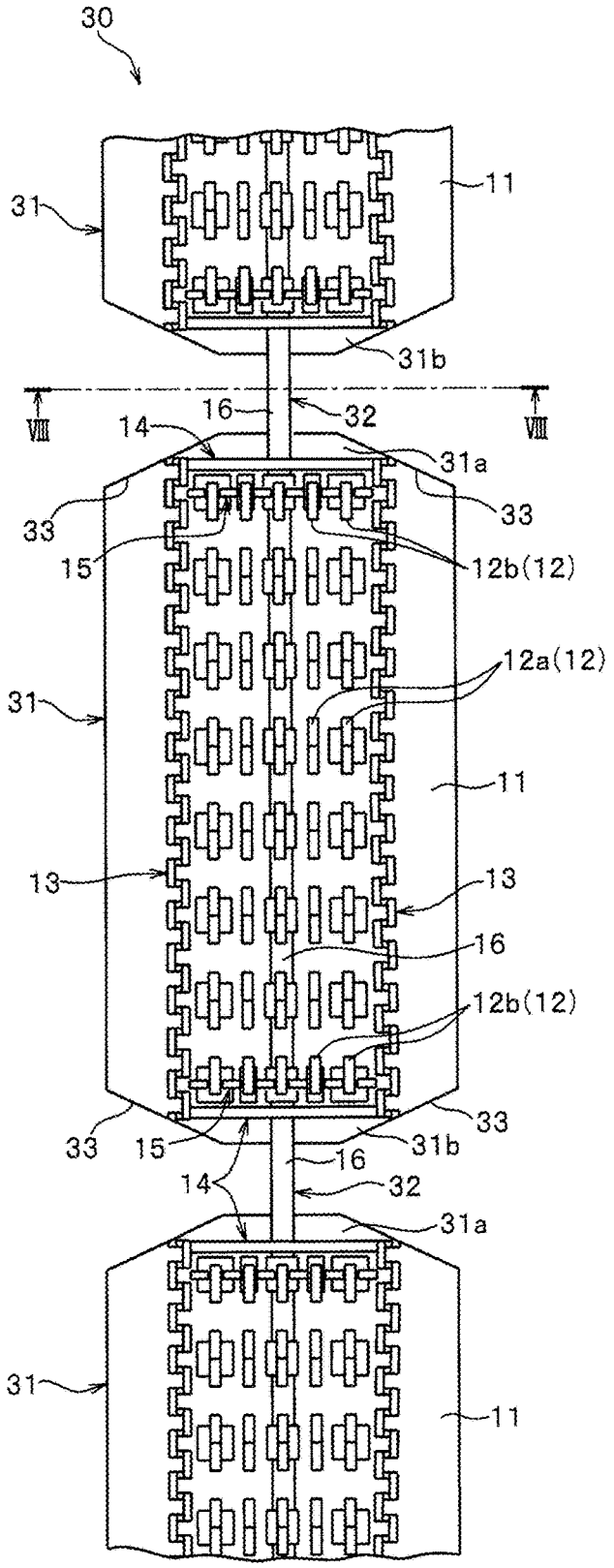
FIG. 7 is a plan view illustrating a molded surface fastener obtained by performing a cutting processing to the molded surface fastener of Embodiment 1.
Figure 8:
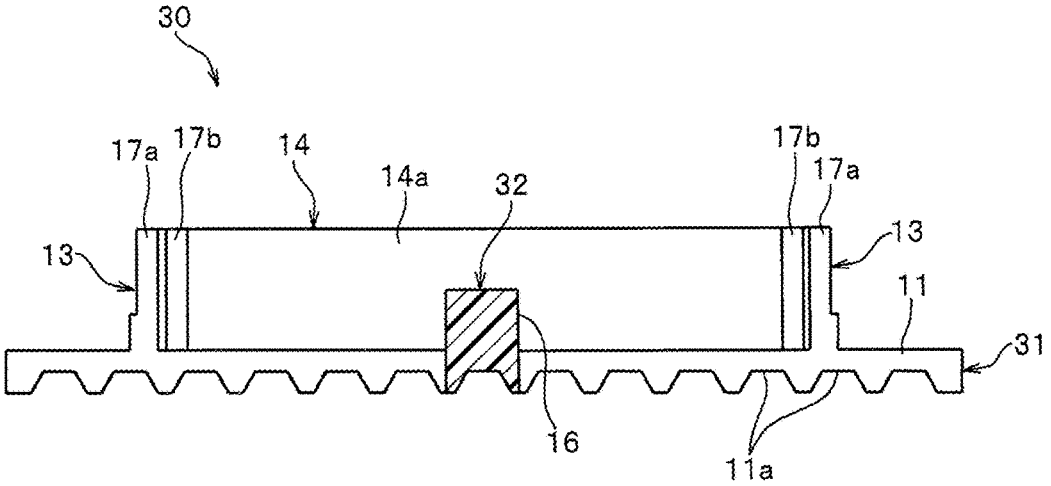
FIG. 8 is a cross-sectional view along the line VIII-VIII of FIG. 7.

Meanwhile, in Embodiment 1, in a case that the molded surface fastener is integrated to the cushion body in a bent state in the width direction from a view of usage of the cushion body and a design of the product, for example, the straight-shaped molded surface fastener 10 as shown in FIG. 1 is used as a primary product, a cutting processing as described later is performed to the molded surface fastener 10, and a molded surface fastener 30 (hereinafter, also referred to as a curve-applicable molded surface fastener 30) applicable to a curve-shaped usage which bends in the width direction as shown in FIGS. 7 and 8 can be obtained.

The curve-applicable molded surface fastener 30 as shown in FIGS. 7 and 8 has a plurality of surface fastener members 31 disposed at predetermined intervals along the length direction and flexible connecting portions 32 connecting adjacent surface fastener members 31.

Each surface fastener member 31 has a thin plate-shaped substrate portion 11 having a cut end portion 33 formed by the cutting processing at the front and rear end portions, the first and second engaging elements 12*a*, 12*b* disposed on an upper surface of the substrate portion 11, left and right resin intrusion barrier portions 13*a*, main lateral wall portions 14, subsidiary lateral wall portions 15 and a convex rib portion 16. In this case, the shape of respective portions formed on the above-mentioned straight-shaped molded surface fastener 10 are retained as they are in the first and second engaging elements 12*a*, 12*b*, the left and right resin intrusion barrier portions 13*a*, the main lateral wall portions 14, the subsidiary lateral wall portions 15 and the convex rib portion 16.

The connecting portion 32 is formed of the convex rib portion 16 disposed in the space region 22 and a part of the substrate portion 11 integrally disposed on a bottom surface side of the convex rib portion 16. As the connecting portion 32 is formed to include the convex rib portion 16, strength of the connecting portion 32 can be increased compared to a case that the connecting portion 32 is formed of the substrate portion 11 only. Therefore, even when the curve-applicable molded surface fastener 30 is pulled in the length direction or bent largely in the width direction, for example, the molded surface fastener 30 is hardly cut at the connecting portion 32.

Further, each connecting portion 32 is integrally connected with the rear side main lateral wall portion 14 disposed at the surface fastener member 31 on a front side of the connecting portion 32 and a rear end extending portion 31*b* of the substrate portion 11 extending rearward from the main lateral wall portion 14, as well as is integrally connected with the front side main lateral wall portion 14 disposed at the surface fastener member 31 on a rear side of the connecting portion 32 and a front end extending portion 31*a* of the substrate portion 11 extending forward from the main lateral wall portion 14. In this case, the front end extending portion 31*a* and the rear end extending portion 31*b* of each surface fastener member 31 are formed of the substrate portion 11 of the space region 22 formed on the straight-shaped molded surface fastener 10.

As the connecting portion 32 (particularly the convex rib portion 16) is integrally connected with the main lateral wall portions 14 and the front and rear extending portions 31*a*, 31*b* of the surface fastener member 31, each fastener member 31 of the molded surface fastener 30 is hardly twisted with respect to the surface fastener member 31 adjacent across the connecting portion 32, and a shape of the molded surface fastener 30 can be stabilized. Thereby, the attaching operation of the molded surface fastener 30 to the surface fastener attaching surface of the molding die can be easily performed, which can improve the operational efficiency.

Here, "integrally connected" means that the connecting portion 32, at least the main lateral wall portion 14 and the front end and rear end extending portions 31*a*, 31*b* are molded using the same thermoplastic resin, melted together, cooled and solidified together. When the magnetic particles are mixed in a part of the thermoplastic resin, as mentioned above, mixing ratio of the magnetic particles may differ in respective portions, depending on the mixing condition. Still, the fact remains that the same thermoplastic resin is used although the mixing ratio is different.

The curve-applicable molded surface fastener 30 having the above structure is manufactured by performing the cutting processing using a cutting apparatus 50 as below to the straight-shaped molded surface fastener 10 which is the primary product.

Figure 9:
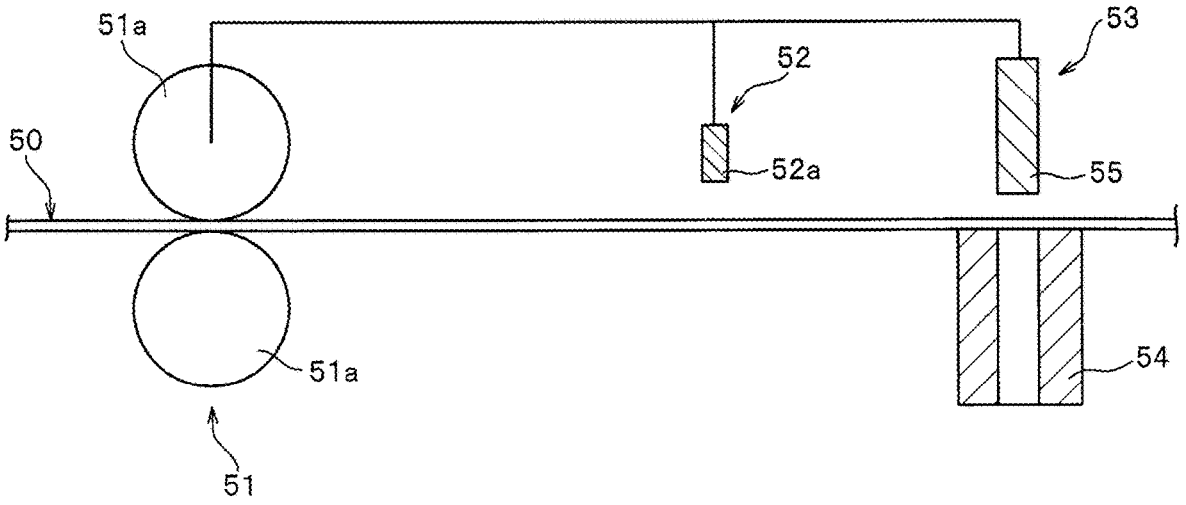
FIG. 9 is a schematic view explaining a process of performing a cutting processing to the molded surface fastener of Embodiment 1.
Figure 10:
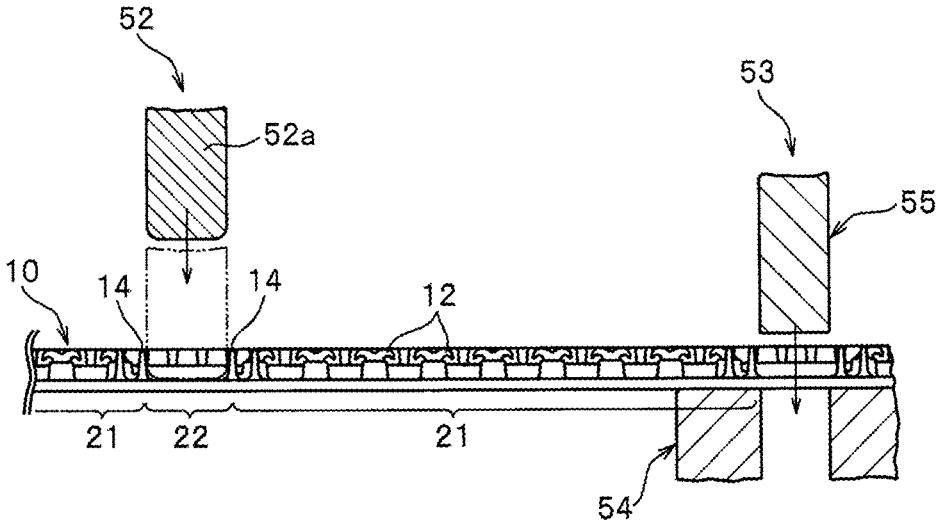
FIG. 10 is a schematic view illustrating a positioning portion and a cut portion disposed in the process of the cutting processing.
Figure 11:
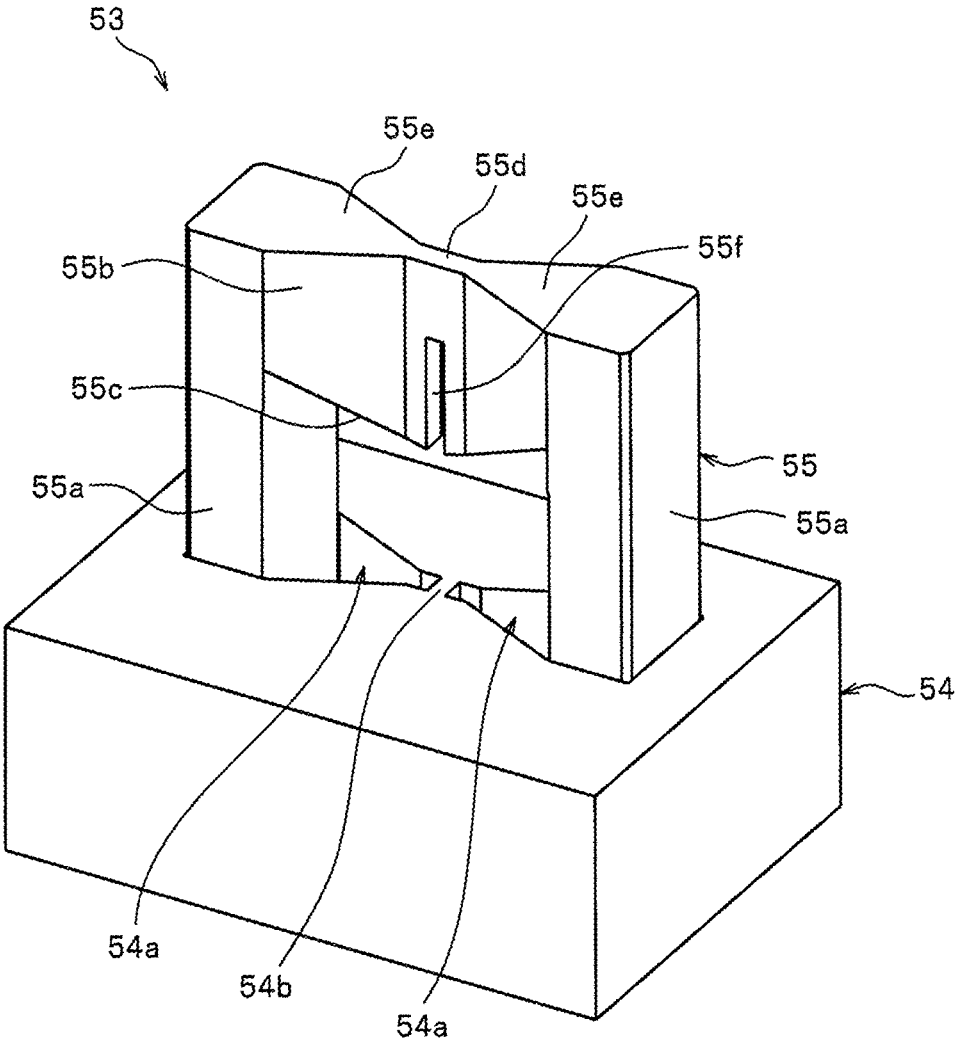
FIG. 11 is a perspective view illustrating a cutting die and a cutting punch of the cut portion.
Figure 12:
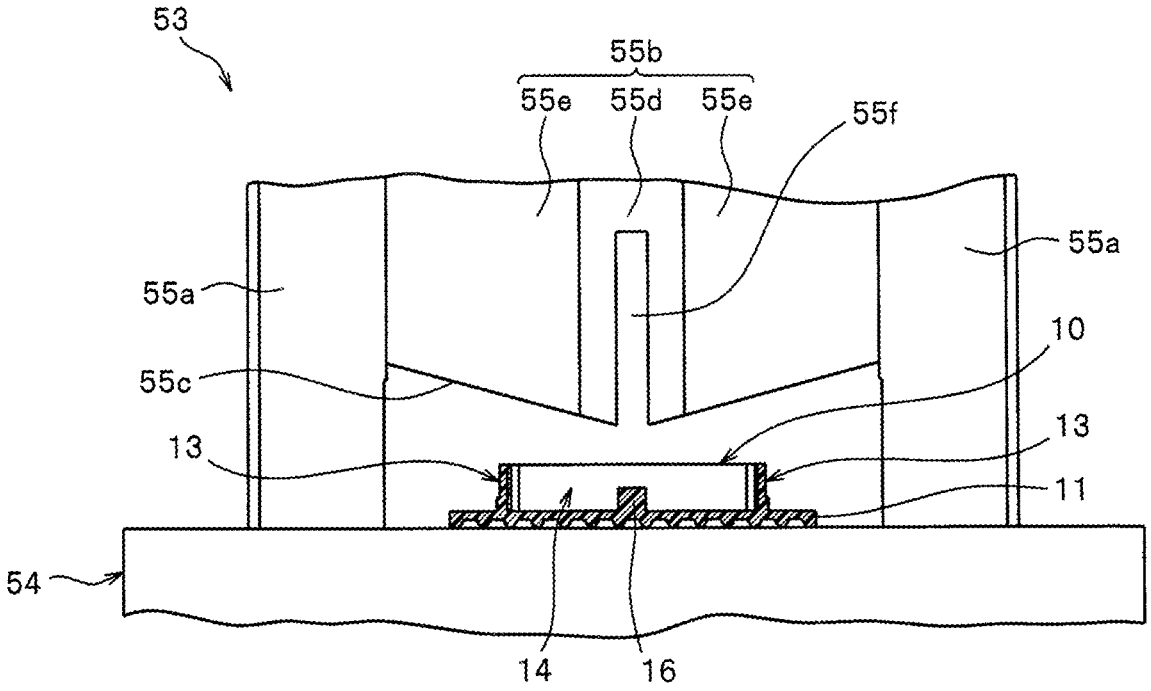
FIG. 12 is a schematic view illustrating a relation between the cut portion and the molded surface fastener.

As shown in FIGS. 9 and 10, the cutting apparatus 50 has a supply portion 51 which supplies the straight-shaped molded surface fasteners 10 and can convey them intermittently, a position detecting portion 52 disposed on a downstream side of the supply portion 51 and detecting a position (stop position) of the molded surface fastener 10, a cutting portion 53 disposed on a downstream side of the position detecting portion 52 and performing the cutting processing to the molded surface fastener 10 whose position is detected and a control portion, not shown in the drawings, connected to the supply portion 51, the position detecting portion 52 and the cutting portion 53 electrically and controlling the supply portion 51, the position detecting portion 52 and the cutting portion 53. In the present invention, positions of the supply portion 51, the position detecting portion 52 and the cutting portion 53 can be randomly changed.

The supply portion 51 has a pair of upper and lower supply rollers 51*a*, and is configured to be able to convey the molded surface fastener 10 to the downstream side, to stop the molded surface fastener 10 and to return the molded surface fastener 10 to the upstream side when it is excessively conveyed to the downstream side by controlling rotation and stop of these supply rollers 51*a*.

The position detecting portion 52 has a positioning member 52*a* disposed on an upper surface side of the conveyed molded surface fastener 10 and capable of moving up and down in an approaching direction and a separating direction with respect to the molded surface fastener 10. The positioning member 52*a* has a shape which can insert to the space region 22 provided between the main lateral wall portions 14 of the straight-shaped molded surface fastener 10.

The position detecting portion 52 can detect a position of the molded surface fastener 10 by inserting the positioning member 52*a* to the space region 22 without having the first and second engaging elements 12*a*, 12*b* of the molded surface fastener 10 when the molded surface fastener 10 conveyed by the supply portion 51 stops at a predetermined position.

The cutting portion 53 has a cutting die 54 on which the conveyed molded surface fastener 10 is placed and a cutting punch 55 which is disposed to be able to move up and down with respect to the cutting die 54 and cuts a part of the molded surface fastener 10 placed on the cutting die 54.

The cutting die 54 has a placement surface (upper surface) on which the molded surface fastener 10 is placed, and left and right die accommodating hole portions 54*a* which can slidably accommodate the cutting punch 55 are provided in the cutting die 54. In this case, between the left and right die accommodating hole portions 54*a*, a narrow width supporting portion 54*b* supporting a part of the convex rib portion 16 of the space region 22 from a bottom surface side of the substrate portion 11 at the time of cutting processing of the space region 22 of the molded surface fastener 10 are disposed.

The left and right die accommodating hole portions 54*a* respectively have an inner side region disposed on a side of the narrow width supporting portion 54*b* and whose dimension in the conveying direction is set to be a constant size, an intermediate region disposed continuously on an outside of the inner side region in the width direction and whose dimension in the conveying direction gradually increases toward the outside and an outer side region disposed continuously on an outside of the intermediate region in the width direction and whose dimension in the conveying direction is set to be a constant size. Left and right leg portions 55*a*, as described later, of the cutting punch 55 are inserted in the outer side region of the die accommodating hole portion 54*a*, and a punch body portion 55*b*, as described later, of the cutting punch 55 is inserted to the intermediate region and the inner side region of the die accommodating hole portions 54*a*.

The cutting punch 55 has the column-shaped left and right leg portions 55*a* which are inserted to the die accommodating hole portion 54*a* of the cutting die 54 and the punch body portion 55*b* which is connected between upper end portions of the left and right leg portions 55*a*, and a tip cutting blade portion (lower end cutting blade portion) 55*c* is formed on a lower end of the punch body portion 55*b*. The left and right leg portions 55*a* have a column shape having a rectangular cross section perpendicular to a height direction. An interval between the left and right leg portions 55*a* (i.e. the width dimension of the punch body portion 55*b*) is set to be larger than the width dimension of the substrate portion 11 of the straight-shaped molded surface fastener 10.

The punch body portion 55*b* has a center cutting portion 55*d* which is disposed at a center portion in the width direction, and whose dimension in the conveying direction is set to be a constant size and left and right slope cutting portion 55*e* which is disposed on both left and right sides of the center cutting portion 55*d*, and whose dimension in the conveying direction gradually increases toward the outside. In a center portion in the width direction of the center cutting portion 55*d*, an insertion groove portion 55*f* to which the convex rib portion 16 of the molded surface fastener 10 can be inserted at the time of cutting processing of the molded surface fastener 10 is formed from the lower end of the punch body portion 55*b* upward.

The tip cutting blade portion 55*c* of the punch body portion 55*b* is formed in an obliquely sloped shape so as to be gradually away from the cutting die 54 from the center portion (a part on a side of the insertion groove portion 55*f*) toward the left and right leg portions 55*a*.

Thereby, when the cutting punch 55 is lowered toward the molded surface fastener 10, as described later, and the cutting processing of the molded surface fastener 10 is performed, the convex rib portion 16 of the space region 22 is inserted into the insertion groove portion 55*f* of the punch body portion 55*b*, the position of the molded surface fastener 10 and the position of the cutting punch 55 are matched, a sharp tip end of the tip cutting blade portion 55*c* can be penetrated to a root part of the convex rib portion 16 of the substrate portion 11, and by further lowering the cutting punch 55, the substrate portion 11 of the molded surface fastener 10 can be cleanly cut in an oblique direction with respect to the width direction from the part in which the tip end of the tip cutting blade portion 55*c* is penetrated to an outside, and a predetermined part of the molded surface fastener 10 can be cut off.

In the present invention, the tip cutting blade portion 55*c* of the punch body portion 55*b* may be formed in an obliquely sloped shape so as to gradually approach the cutting die 54 from the center portion in the width direction toward the left and right leg portions 55*a*. In this case, when the molded surface fastener 10 is subjected to the cutting processing, the substrate portion 11 of the molded surface fastener 10 can be cleanly cut from the left and right side edges of the substrate portion 11 to an inside.

When the cutting processing of the straight-shaped molded surface fastener 10 is performed using the above-mentioned cutting apparatus 50, first, conveying the molded surface fastener 10 toward the downstream side at a predetermined length, and stopping the conveyance of the molded surface fastener 10 are alternately repeated by intermittently rotating the upper and lower supply rollers 51*a* of the supply portion 51. At this time, the length of conveying the molded surface fastener 10 to the downstream side corresponds to an interval between the space regions 22 formed in the molded surface fastener 10.

While the molded surface fastener 10 is intermittently conveyed in the supply portion 51, the positioning member 52*a* of the position detecting portion 52 is lowered to a predetermined position along with a timing of stopping the conveyance of the molded surface fastener 10, and the positioning member 52*a* is inserted to the space region 22 without having the first and second engaging elements 12*a*, 12*b* of the molded surface fastener 10. Thereby it can be detected that the molded surface fastener 10 is stopped, and the stopping position is at a predetermined position on the conveyance way.

In Embodiment 1, particularly, the space region 22 of the molded surface fastener 10 is disposed between the main lateral wall portions 14 having high rigidity, and is formed widely with a certain degree of length dimension. Therefore, by inserting the positioning member 52*a* of the position detecting portion 52 into the space region 22, the positioning member 52*a* can be precisely and stably inserted when compared to a case that a small positioning member is inserted between first engaging elements 12*a* adjacent in the length direction, for example, and the stopping position of the molded surface fastener 10 can be accurately detected as well as the first and second engaging elements 12*a*, 12*b* disposed on the engaging region 21 can be prevented from being deformed or damaged.

Further, due to the stable insertion of the positioning member 52*a*, when compared to a case that the small positioning member is inserted between the engaging elements 12, for example, a position of the molded surface fastener 10 can be stably detected even if the conveyance rate of the molded surface fastener 10 conveyed by the supply portion 51 is increased, and the conveyance and the stopping are repeated. Therefore, the cutting processing of the molded surface fastener 10 can be precisely and efficiently performed.

When the stopping position of the molded surface fastener 10 is detected by lowering the positioning member 52*a* of the position detecting portion 52, in a case that the stopping position of the molded surface fastener 10 is displaced in the front and rear direction of the conveyance direction, for example, the positioning member 52*a* is contacted (interfered) with the main lateral wall portions 14 of the molded surface fastener 10, and the positioning member 52*a* cannot be lowered to a predetermined position.

In this case, the control portion of the cutting apparatus 50, which is not shown in the drawings, judges that the molded surface fastener 10 is not stopped at a predetermined stopping position, and sends out a signal to the supply portion 51 to rotate the upper and lower supply rollers 51*a* so as to slightly move the molded surface fastener 10 to the conveying direction or the opposite direction. Thereby, the stopping position of the molded surface fastener 10 can be adjusted so that the positioning member 52*a* is lowered to a predetermined position with respect to the molded surface fastener 10.

After the position detecting portion 52 detects that the molded surface fastener 10 is stopped at a predetermined position, the cutting punch 55 of the cutting portion 53 is lowered, and the cutting processing is performed to the molded surface fastener 10.

In this case, the cutting processing is performed by the tip cutting blade portion 55*c* of the cutting punch 55 to cut off a part of the space region 22 and a part of the substrate portion 11 of the engaging region 21 so that the convex rib portion 16 of the space region 22 in the molded surface fastener 10, a part of the substrate portion 11 integrally formed on a bottom surface side of the convex rib portion 16 and a part extending from the main lateral wall portion 14 (parts corresponding to the front and rear end extending portions 31*a*, 31*b* of the surface fastener member 31) are remained.

Then, after the cutting processing is performed by the cutting portion 53, the molded surface fastener 10 is conveyed to the downstream side at a predetermined length and stopped again, and further the stopping position of the molded surface fastener as mentioned above is detected at the position detecting portion 52, and the cutting processing is performed at the cutting portion 53. By performing such an operation repeatedly to the whole straight-shaped molded surface fastener 10, the curve-applicable molded surface fastener 30 as shown in FIG. 7 can be easily and stably manufactured.

As mentioned above, in Embodiment 1, the straight-shaped molded surface fastener 10 is used as a primary product, and the curve-applicable molded surface fastener 30 can be manufactured. Thereby the same molding apparatus 40 can be used between the straight-shaped molded surface fastener 10 and the curve-applicable molded surface fastener 30, and there is no need to manufacture the straight-shaped molded surface fastener and the curve-applicable molded surface fastener separately by different manufacturing apparatuses and different manufacturing processes, as in a conventional manner. Thus, the manufacturing efficiency of the curve-applicable molded surface fastener 30 can be improved and a manufacturing cost of the curve-applicable molded surface fastener 30 can be reduced.

In addition, since the curve-applicable molded surface fastener 30 is manufactured using the straight-shaped molded surface fastener 10, it becomes easier to cope with demands for respective molded surface fasteners 10 promptly, and inventory management of the molded surface fasteners 10, 30 can be made easily. Therefore, further economic benefit can be obtained.

Then, when the curve-applicable molded surface fastener 30 manufactured as above is integrated to a cushion body, the molded surface fastener 30 can be integrated to the cushion body in a bent state in the width direction depending on usage of the cushion body and a design of the product for example.

In this case, first, the curve-applicable molded surface fastener 30 is placed on a surface fastener attaching surface (surface fastener placing surface) of a molding die to perform foam molding of the cushion body in a bent state in the width direction and/or the top and bottom direction.

Similar to the above-mentioned straight-shaped molded surface fastener 10, the molded surface fastener 30 is attracted and fixed to the surface fastener attaching surface of the molding die by a magnet such as neodymium magnet buried to correspond to a position of the surface fastener attaching surface of the molding die, and a position and a direction of the molded surface fastener 30 with respect to the molding die can be accurately and automatically adjusted by a self-alignment effect. Further, respective upper surfaces of the left and right continuous wall portions 13, the main lateral wall portions 14 and the subsidiary lateral wall portions 15 of the molded surface fastener 30 are held in a close contact state with the surface fastener attaching surface of the molding die.

Next, a foam resin material is injected in the molding die in which the molded surface fastener 30 is fixed at a predetermined position by spraying from an injection nozzle disposed on the molding die, and the resin material foams and spreads throughout the cavity space of the molding die to mold a cushion body. At this time, the position of the molded surface fastener 30 is not moved by a flowing pressure or a foaming pressure of the foam resin material. The foam resin material can be prevented from intruding into the forming region of the first and second engaging elements 12*a*, 12*b* over the continuous wall portions 13, the main lateral wall portions 14 and the subsidiary lateral wall portions 15.

Thereafter, as the foam resin material is foamed and solidified, and the molding is completed, the cushion body to which the curve-applicable molded surface fastener 30 is integrated can be obtained.

In thus obtained cushion body with the curve-applicable molded surface fastener 30, the first and second engaging elements 12*a*, 12*b* in a region surrounded by the left and right continuous wall portions 13 and front and rear main lateral wall portions 14 in the engaging region 21 are not buried in the cushion body but are exposed. Therefore, a predetermined engaging force obtained by the first and second engaging elements 12*a*, 12*b* can be stably secured.

Therefore, by covering a skin material to a surface of the cushion body and pressing the skin material toward the molded surface fastener 30 which is integrated to the cushion body in a bent state, the skin material can be precisely attached along the surface of the cushion body without being lifted up from the cushion body.

In Embodiment 1, after the straight-shaped molded surface fastener 10 is manufactured using the manufacturing apparatus 40 as shown in FIG. 6 and collected, the cutting processing is performed to the collected straight-shaped molded surface fastener 10 using the cutting apparatus 50 as shown in FIG. 9 provided separately from the manufacturing apparatus 40, and the curve-applicable molded surface fastener 30 is manufactured. In the present invention, however, the curve-applicable molded surface fastener 30 can be directly manufactured by setting the cutting apparatus 50 shown in FIG. 9 continuously after the manufacturing apparatus 40 shown in FIG. 6 without collecting and storing the straight-shaped molded surface fastener 10.

In Embodiment 1, the curve-applicable molded surface fastener 30 is manufactured by performing the cutting processing by the cutting apparatus 50 to respective space regions 22 provided on the straight-shaped molded surface fastener 10. In the present invention, however, the cutting processing may not be operated to all the space regions 22, and the curve-applicable molded surface fastener 30 may be manufactured by performing the cutting processing to a part of the space regions 22, by such one cutting processing to every two space regions 22, for example.

In addition, regarding the manufacturing method of the curve-applicable molded surface fastener 30, in the cutting apparatus 50 as shown in FIG. 9, while the molded surface fastener 10 is intermittently conveyed at the supply portion 51, a stopping position of the molded surface fastener 10 is detected at the position detecting portion 52, and the cutting processing is performed at the cutting portion 53 with respect to the stopped molded surface fastener 10.

In the present invention, however, it is also possible to configure the cutting apparatus so that, for example, the position detecting portion 52 and the cutting portion 53 are movable in the front and rear direction along the conveying direction of the molded surface fastener 10, the position detecting portion 52 moves and detects the position of the molded surface fastener 10 during the conveyance, and the cutting portion 53 can perform the cutting processing to the molded surface fastener 10 during the conveyance.

By using such a cutting apparatus, the relative position of the molded surface fastener 10 is detected at the position detecting portion 52 with respect to the molded surface fastener 10 during the conveyance, while the molded surface fastener 10 is conveyed continuously at the supply portion 51 without stopping, and the cutting processing can be performed at the cutting portion 53.

Thereby, the curve-applicable molded surface fastener 30 can be manufactured more efficiently from the straight-shaped molded surface fastener 10, which can further reduce the manufacturing cost.

Figure 13:
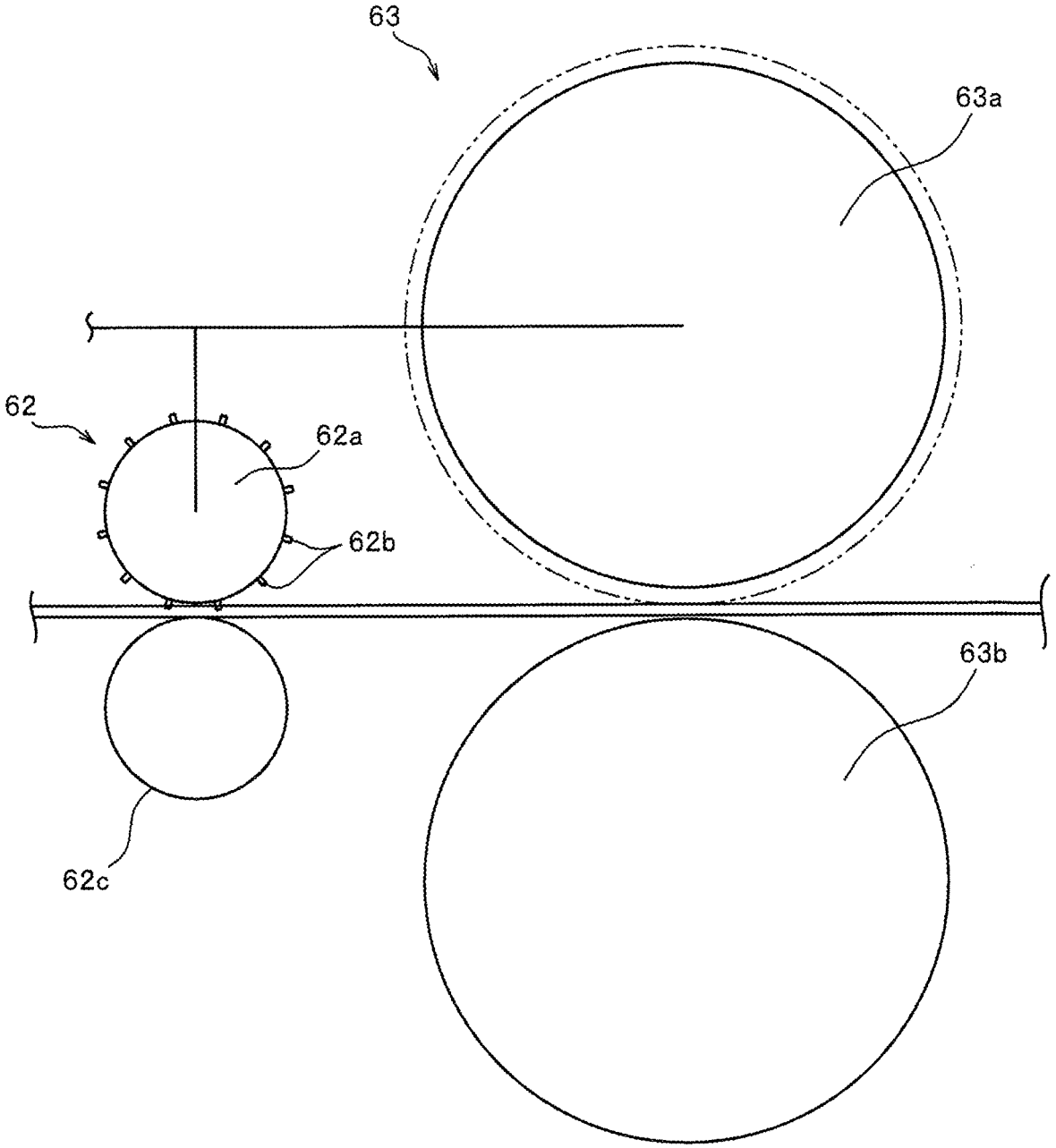
FIG. 13 is a schematic view illustrating a positioning roller and a rotary die cutter disposed in a process of the cutting processing.

Further, in Embodiment 1, a position detecting portion 62 and a cutting portion 63 as shown in FIG. 13 can be used in place of the position detecting portion 52 and the cutting portion 53 as shown in FIG. 9.

The position detecting portion 62 as shown in FIG. 13 has a positioning roller 62*b* disposed rotatably on an upper surface side of the conveyed molded surface fastener 10, a plurality of positioning members 62*a* disposed on a periphery of the positioning roller 62*b* at predetermined intervals and a supporting roller 62*c* disposed on a lower surface side of the molded surface fastener 10.

Each positioning member 62*a* has a shape which can be inserted into the space region 22 provided between the main lateral wall portions 14 of the straight-shaped molded surface fastener 10.

In the position detecting portion 62, the positioning roller 62*b* is rotated corresponding to a conveying rate of the molded surface fastener 10, and the positioning members 62*a* is inserted into the space region 22 of the continuously conveyed molded surface fastener 10, thereby a position of the conveyed molded surface fastener 10 can be continuously detected.

The cutting portion 63, as shown in FIG. 13, has a rotary die 63*a* in which a knife portion is provided on a periphery and an anvil roller 63*b* in which a periphery is formed to be flat.

In this case, the knife portion provided at the rotary die 63*a* is disposed so as to correspond to a shape of the cut end portion 33 of the surface fastener portion and a shape of the connecting portion 32 of the curve-applicable molded surface fastener 30.

In this cutting portion 63, the straight-shaped molded surface fastener 10 whose position is detected at the position detecting portion 62 is continuously supplied between the rotary die 63*a* and the anvil roller 63*b*, and the rotary die 63*a* is rotated corresponding to the conveying rate of the molded surface fastener 10, thereby the cutting processing to cut off a predetermined part of the straight-shaped molded surface fastener 10 can be performed.

In a case that the cutting processing is performed to the straight-shaped molded surface fastener 10 using the cutting apparatus having the position detecting portion 62 and the cutting portion 63, while the molded surface fastener 10 is continuously conveyed without stopping at the supply roller 51*a* of the supply portion 51, the positioning roller 62*b*, the rotary die 63*a* and the anvil roller 63*b* are rotated corresponding to the conveying rate of the molded surface fastener 10. Thereby, the position of the molded surface fastener 10 can be continuously detected, and a predetermined cutting processing of the molded surface fastener 10 can be performed.

In Embodiment 1, a single curve-applicable molded surface fastener 30 is manufactured by molding a single straight-shaped molded surface fastener 10, and performing a predetermined cutting processing with respect to the obtained straight-shaped molded surface fastener 10 thereafter.

In the present invention, however, it is also possible to manufacture a plurality of curve-applicable molded surface fasteners 30 by molding a sheet-shaped primary product (a sheet-shaped molded surface fastener) in which a plurality (four, for example) of straight-shaped molded surface fasteners 10 are connected in the width direction and which is large in the width direction, and performing a predetermined cutting processing to the obtained sheet-shaped primary product.

Specifically, the sheet-shaped molded surface fastener as a primary product is molded by a manufacturing apparatus (molding apparatus) having a die wheel on which a predetermined cavity space is formed on a periphery. The molded sheet-shaped molded surface fastener is continuously peeled off from the periphery of the die wheel by a pickup roller.

The peeled sheet-shaped molded surface fastener is conveyed toward the position detecting portion and the cutting portion by the supply portion having upper and lower supply rollers. In this case, the position detecting portion is configured similar to the position detecting portion 62 as shown in FIG. 13, for example, and has a positioning roller disposed on an upper surface side of the sheet-shaped molded surface fastener, a plurality of positioning members disposed on the periphery of the positioning roller and a supporting roller disposed on a lower surface of the sheet-shaped molded surface fastener.

Figure 14:
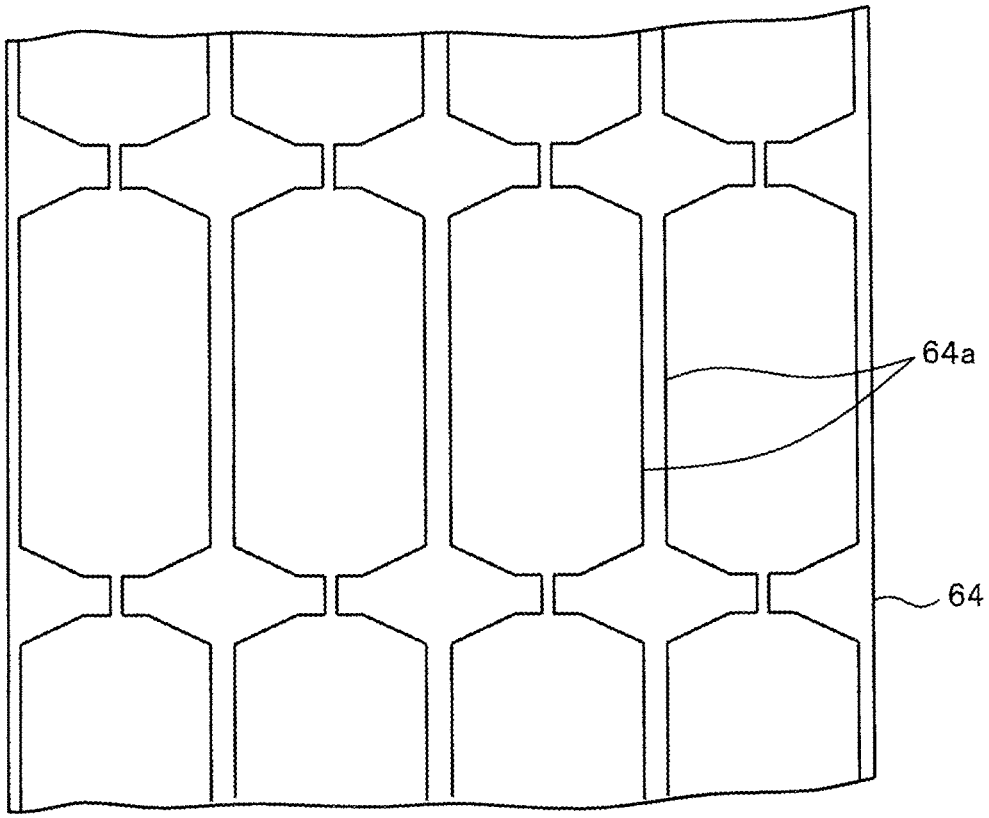
FIG. 14 is a schematic view illustrating a cut edge portion of the rotary die cutter.

The cutting portion has a rotary die 64 on which a cutting blade portion 64*a* having a shape as shown in FIG. 14 is provided on a periphery, for example, and an anvil roller formed to have a flat periphery.

Since the sheet-shaped molded surface fastener is continuously conveyed toward the position detecting portion and the cutting portion having such a structure, the position of the sheet-shaped molded surface fastener is detected at the position detecting portion, a predetermined cutting processing is performed to the sheet-shaped molded surface fastener at the cutting portion, and four curve-applicable molded surface fasteners 30 as shown in FIG. 7 can be manufactured simultaneously. Thereby, mass production of the curve-applicable molded surface fasteners 30 at a short time can be possible.

Embodiment 2

Figure 15:
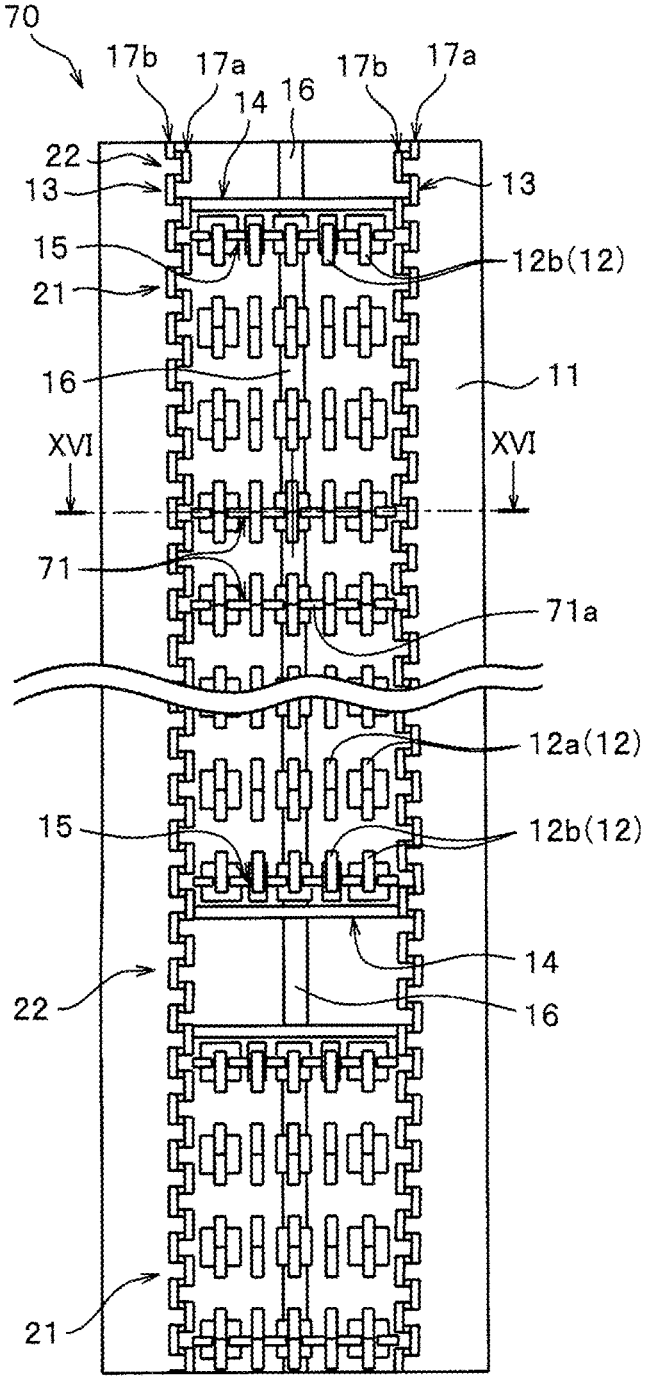
FIG. 15 is a plan view illustrating a molded surface fastener according to Embodiment 2 of the present invention.
Figure 16:
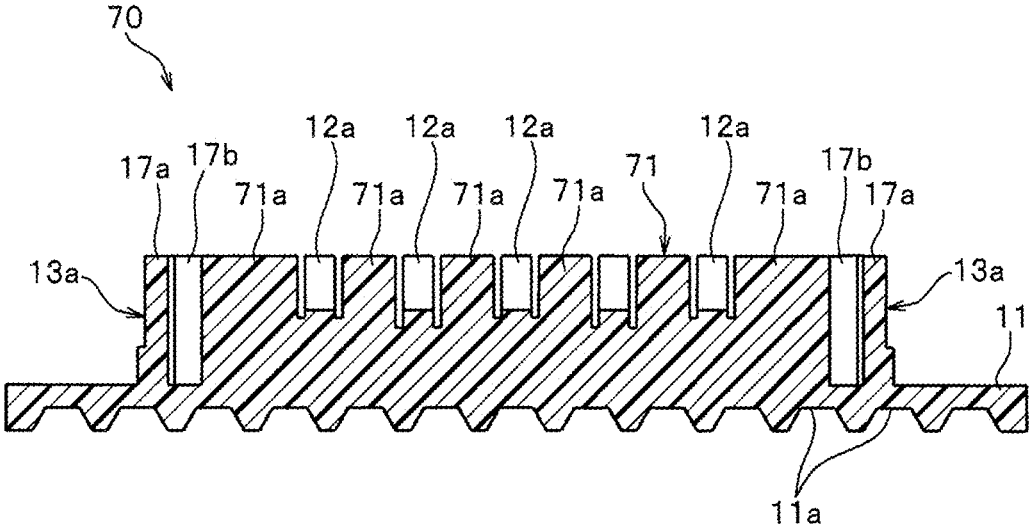
FIG. 16 is a cross-sectional view along the line XVI-XVI of FIG. 15.

FIG. 15 is a plan view illustrating a molded surface fastener according to Embodiment 2, and FIG. 16 is a cross-sectional view along the line XVI-XVI in FIG. 15.

Regarding a molded surface fastener 70 according to Embodiment 2 and a molded surface fastener 80 according to Embodiment 3, as described later, structural features different from the molded surface fastener 10 of Embodiment 1 will be mainly described, and parts and members having substantially same as those of the molded surface fastener 10 of Embodiment 1 will not be described but represented by the same reference numerals.

In the molded surface fastener 70 according to Embodiment 2, in addition to the structural features of the straight-shaped molded surface fastener 10 according to the above-mentioned Embodiment 1, a plurality of auxiliary divided wall bodies 71*a* are disposed along the width direction at a position of a lateral row of the first engaging elements 12*a* disposed in line in the engaging region 21, thereby an auxiliary lateral wall portion 71 configured of the first engaging elements 12*a* of the lateral row and the auxiliary divided wall bodies 71*a* are provided. In Embodiment 2, in particular, the auxiliary lateral wall portions 71 are provided at positions of the third lateral row and the fourth lateral row disposed at a center portion among six lateral rows of the first engaging elements 12*a* along the width direction in the engaging region 21.

It should be noted that the position of the auxiliary lateral wall portion 71 is not particularly limited, and the auxiliary lateral wall portion 71 may be provided at a random lateral row among the first to sixth lateral rows formed in the engaging region 21, or the auxiliary lateral wall portions 71 may be provided at all of the lateral rows of the first to the sixth lateral rows formed in the engaging region 21.

When, for example, the molded surface fastener 70 is cut along the width direction at a part of the engaging region 21 in order to have a desired length of the straight-shaped molded surface fastener 70, as the auxiliary lateral wall portion 71 is provided as in the molded surface fastener 70 according to Embodiment 2, the auxiliary lateral wall portion 71 disposed in the engaging region 21 can be used as an intrusion barrier portion to prevent the intrusion of the foam resin material at the foam molding of the cushion body.

Therefore, the foam resin material can be prevented from intruding into a whole region of the cut engaging region 21, and a part of the first engaging elements 12*a* at the engaging region 21 can be exposed without being buried in the cushion body. Thus, an engaging area of the molded surface fastener 70 with which a skin material is able to be effectively engaged can be enlarged, and the skin material can be stably fixed to the cushion body in which the molded surface fastener 70 is integrated.

In a case of the straight-shaped molded surface fastener 70 of Embodiment 2, similar to the molded surface fastener 10 according to the above-mentioned Embodiment 1, a curve-applicable molded surface fastener which can bend in the width direction can be manufactured by using it as a primary product and performing the cutting processing as explained in the above-mentioned Embodiment 1. In this case, the effects as explained in the above-mentioned Embodiment 1 can be also obtained.

In the curve-applicable molded surface fastener manufactured from the straight-shaped molded surface fastener 70 of Embodiment 2, similar to a case of the straight-shaped molded surface fastener 70, the auxiliary lateral wall portions 71 disposed at each surface fastener member 31 can be used as intrusion barrier portions to prevent the foam resin material from intruding at the time of foam molding of the cushion body.

Embodiment 3

Figure 17:
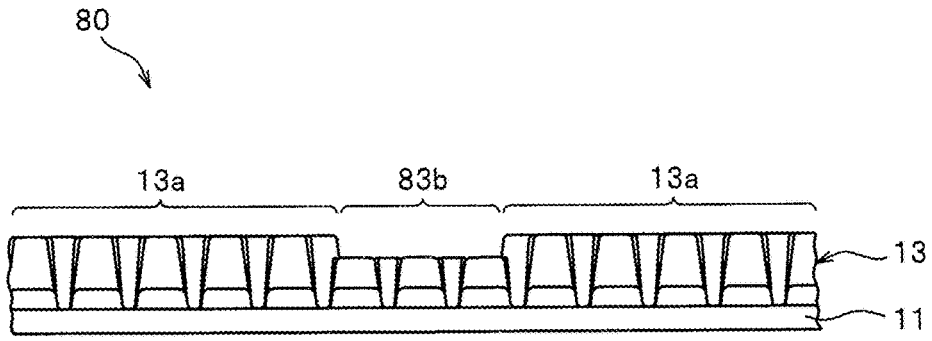
FIG. 17 is a side view of a molded surface fastener according to Embodiment 3 of the present invention.

FIG. 17 is a side view of a molded surface fastener according to Embodiment 3.

In a straight-shaped molded surface fastener 80 of Embodiment 3, a height dimension of the vertical wall portion 83*b* disposed in the space region 22 from the substrate portion 11 is configured to be lower than that of the straight-shaped molded surface fastener 10 according to Embodiment 1, and other than that, it has the same structure as the straight-shaped molded surface fastener 10 according to the above-mentioned Embodiment 1.

That is, the height dimension of the vertical wall portion 83*b* disposed in the space region 22 of Embodiment 3 from the substrate portion 11 is lower than that of the resin intrusion barrier portion 13*a* disposed in the engaging region 21. As the vertical wall portion 83*b* having a lower height and the convex rib portion 16 are disposed in the space region 22, when the straight-shaped molded surface fastener 80 according to Embodiment 3 is molded using the molding apparatus having a die wheel, the peeling resistance to peel off a part of the space region 22 from the die wheel 41 increases, and the force to peel the molded surface fastener 80 off can be prevented from being uneven in the length direction of the molded surface fastener 80. Therefore, the engaging elements 12 disposed near the space region 22 hardly receive a large force when the molded surface fastener 80 is peeled off from the die wheel, and the engaging elements 12 having a predetermined shape can be molded stably.

As the molded surface fastener 80 of Embodiment 3 in which the height dimension of the vertical wall portion 83*b* disposed in the space region 22 is smaller than the height dimension of the resin intrusion barrier portion 13*a* disposed in the engaging region 21, when the molded surface fastener 80 is attracted and fixed to the molding die, and a cushion body is foamed and molded, similar to the above-mentioned Embodiment 1, the foam resin material can be prevented from intruding into the forming region of the first and second engaging elements 12*a*, 12*b* over the continuous wall portion 13, the main lateral wall portion 14 and the subsidiary lateral wall portion 15, and a predetermined engaging force obtained by the first and second engaging elements 12*a*, 12*b* can be stably secured.

Figure 18:
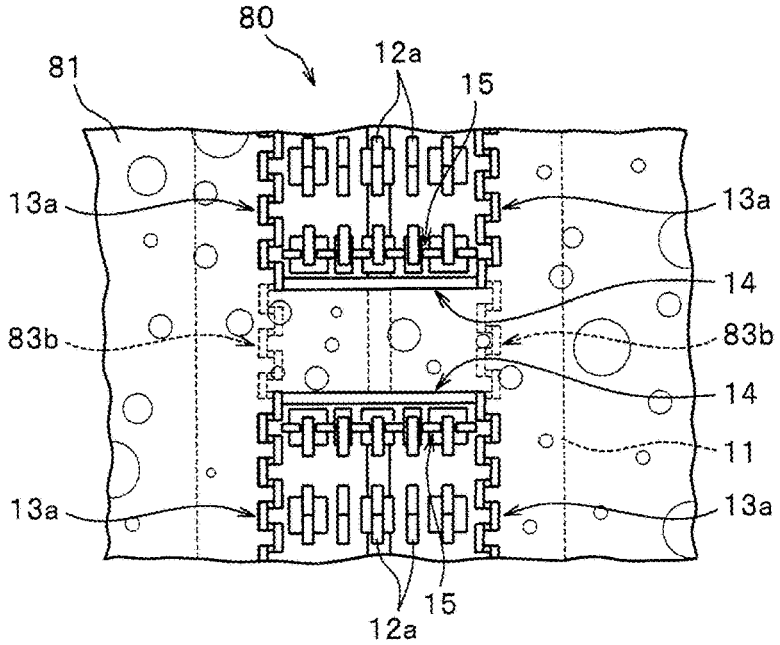
FIG. 18 is a schematic view illustrating a state that the molded surface fastener is integrated to a cushion body.

On the other hand, by permitting the intrusion of the foam resin material into the space region 22 at the time of foam molding, the left and right vertical wall portions 83*b* disposed in the space region 22, the substrate portion 11 and the convex rib portion 16 disposed between the left and right vertical wall portions 83*b* can be buried in the cushion body 81, as shown in FIG. 18.

Thereby, a contact area between the molded surface fastener 80 and the cushion body 81 is further enlarged, which can further enhance the fixing strength of the molded surface fastener 80 with respect to the cushion body 81.

In the straight-shaped molded surface fastener 80 of Embodiment 3, similar to a case of the molded surface fastener 10 according to the above-mentioned Embodiment 1, the curve-applicable molded surface fastener which can bend in the width direction can be manufactured by using it as a primary product and performing the cutting processing as explained in the above-mentioned Embodiment 1.

In this case, the effects as explained in the above-mentioned Embodiment 1 can be also obtained.

REFERENCE SIGNS LIST

10: MOLDED SURFACE FASTENER
11: SUBSTRATE PORTION
11*a*: CONCAVE GROOVE PORTION
12: ENGAGING ELEMENT
12*a*: FIRST ENGAGING ELEMENT
12*b*: SECOND ENGAGING ELEMENT
13: CONTINUOUS WALL PORTION
13*a*: RESIN INTRUSION BARRIER PORTION
13*b*: VERTICAL WALL PORTION
14: MAIN LATERAL WALL PORTION
14*a*: CONTINUOUS LATERAL WALL BODY
15: SUBSIDIARY LATERAL WALL PORTION
15*a*: DIVIDED LATERAL WALL BODY
16: CONVEX RIB PORTION
17*a*: FIRST CONTINUOUS VERTICAL WALL PORTION (FIRST CONTINUOUS VERTICAL WALL ROW)
17*b*: SECOND CONTINUOUS VERTICAL WALL PORTION (SECOND CONTINUOUS VERTICAL WALL ROW)
18: VERTICAL WALL BODY
19: WALL CONNECTING PORTION
21: ENGAGING REGION
22: SPACE REGION
30: MOLDED SURFACE FASTENER
31: SURFACE FASTENER MEMBER
31*a*: FRONT END EXTENDING PORTION
31*b*: REAR END EXTENDING PORTION
32: CONNECTING PORTION
33: CUT END PORTION
40: MANUFACTURING APPARATUS (MOLDING APPARATUS)
41: DIE WHEEL

42: CONTINUOUS EXTRUSION NOZZLE
43: PICKUP ROLLER
50: CUTTING APPARATUS
51: SUPPLY PORTION
51*a*: SUPPLY ROLLER
52: POSITION DETECTING PORTION
52*a*: POSITIONING MEMBER
53: CUTTING PORTION
54: CUTTING DIE
54*a*: DIE ACCOMMODATING HOLE PORTION
54*b*: NARROW WIDTH SUPPORTING PORTION
55: CUTTING PUNCH
55*a*: LEG PORTION
55*b*: PUNCH BODY PORTION
55*c*: TIP CUTTING BLADE PORTION (LOWER END CUTTING BLADE PORTION)
55*d*: CENTER CUTTING PORTION
55*e*: SLOPED CUTTING PORTION
55*f*: INSERTION GROOVE PORTION
62: POSITION DETECTING PORTION
62*a*: POSITIONING MEMBER
62*b*: POSITIONING ROLLER
62*c*: SUPPORTING ROLLER
63: CUTTING PORTION
63*a*: ROTARY DIE
63*b*: ANVIL ROLLER
64: ROTARY DIE
64*a*: CUTTING BLADE PORTION
70: MOLDED SURFACE FASTENER
71: AUXILIARY LATERAL WALL PORTION
71*a*: AUXILIARY DIVIDED WALL BODY
80: MOLDED SURFACE FASTENER
81: CUSHION BODY
83*b*: VERTICAL WALL PORTION

The invention claimed is:

1. A molded surface fastener made of thermoplastic resin which is integrated to a surface of a cushion body when the cushion body is foamed and molded, including a plurality of engaging regions in which a plurality of hook-shaped engaging elements stand on a first surface of a thin plate-shape substrate portion and a plurality of space regions having a flat surface in which the engaging elements are excluded on the substrate portion, wherein the plurality of engaging regions and the plurality of space regions are disposed alternately in a length direction, wherein each of the engaging regions has a pair of left and right resin intrusion barrier portions standing along the length direction at left and right side edge portions of the substrate portion and main lateral wall portions standing along a width direction at a front end edge portion and a rear end edge portion of the engaging region so as to compart from adjacent of the space regions, wherein each of the space regions has a pair of left and right vertical wall portions standing along the length direction at the left and right side edge portions of the substrate portion and a convex rib portion projecting integrally from the substrate portion along the length direction at a center portion in the width direction of the substrate portion, and the convex rib portion is integrally connected to the main lateral wall portions adjacent to the space region in the length direction.

2. The molded surface fastener according to claim 1, wherein the substrate portion, the resin intrusion barrier portions, the main lateral wall portions, the vertical wall portions and the convex rib portions are configured to use the same thermoplastic resin.

3. The molded surface fastener according to claim 2, wherein the plurality of space regions includes the space regions having front and rear cut end portions formed by a cutting processing that cuts a part of the respective space region so that at least the convex rib portion remains, and the space regions having the front and rear cut end portions formed by the cutting processing comprise flexible connecting portions including the respective convex rib portions, and the molded surface fastener is formed to be able to bend in the width direction.

4. The molded surface fastener according to claim 1, wherein the resin intrusion barrier portion of the engaging region and the vertical wall portions of the space region are formed as a series of continuous wall portions standing continuously along the length direction on the entire substrate portion.

5. The molded surface fastener according to claim 4, wherein the plurality of space regions includes the space regions having front and rear cut end portions formed by a cutting processing that cuts a part of the respective space region so that at least the convex rib portion remains, and the space regions having the front and rear cut end portions formed by the cutting processing comprise flexible connecting portions including the respective convex rib portions, and the molded surface fastener is formed to be able to bend in the width direction.

6. The molded surface fastener according to claim 1, wherein the engaging region has auxiliary lateral wall portions disposed along the width direction at intermediate positions between the main lateral wall portion on a side of the front end edge portion and the main lateral wall portion on a side of the rear end edge portion.

7. The molded surface fastener according to claim 6, wherein the plurality of space regions includes the space regions having front and rear cut end portions formed by a cutting processing that cuts a part of the respective space region so that at least the convex rib portion remains, and the space regions having the front and rear cut end portions formed by the cutting processing comprise flexible connecting portions including the respective convex rib portions, and the molded surface fastener is formed to be able to bend in the width direction.

8. The molded surface fastener according to claim 1, wherein the plurality of space regions includes the space regions having front and rear cut end portions formed by a cutting processing that cuts a part of the respective space region so that at least the convex rib portion remains, and the space regions having the front and rear cut end portions formed by the cutting processing comprise flexible connecting portions including the respective convex rib portions, and the molded surface fastener is formed to be able to bend in the width direction.

9. The molded surface fastener according to claim 1, wherein at least one of the space regions is spaced between two of the main lateral wall portions.

10. A method for manufacturing a molded surface fastener in which a plurality of surface fastener members in which a plurality of hook-shaped engaging elements stand on a first surface of a substrate portion are connected in a length direction by a flexible connecting portions, and which can be integrated to a surface of a cushion body in a bent state in a width direction when the cushion body is foamed and molded, wherein the method includes:

molding the molded surface fastener as a primary product using a die wheel in which a cavity space is formed on a periphery, in which the substrate portion has engaging regions on which the plurality of the engaging elements stand on the substrate portion and space regions having a flat surface on which the engaging elements are excluded on the substrate portion alternately in the length direction, the engaging region has a pair of left and right resin intrusion barrier portions standing along the length direction at left and right side edge portions of the substrate portion and main lateral wall portions standing along the width direction continuously between the left and right resin intrusion barrier portions at both end edge portions in the length direction of the engaging region so as to compart from the space region, the space region has a pair of left and right vertical wall portions standing along the length direction at the left and right side edge portions of the substrate portion and a convex rib portion projecting integrally from the substrate portion along the length direction at a center portion in the width direction of the substrate portion, peeling off the molded surface fastener as the primary product from the die wheel, detecting a position of the molded surface fastener by inserting a positioning member to the space region in the molded surface fastener as the primary product and performing a cutting processing to the molded surface fastener whose position is detected to cut off the space region so that at least the convex rib portion is remained.

11. The method for manufacturing the molded surface fastener according to claim 10, including:

inserting the positioning member to the space region by intermittently stopping the conveyance of the molded surface fastener when detecting a position of the molded surface fastener as the primary product and performing the cutting processing when the molded surface fastener is stopped by moving up and down a cutting punch having a tip cutting blade portion sloped outward from a center portion in the width direction of the substrate portion at a predetermined position.

12. The method for manufacturing the molded surface fastener according to claim 10, including:

conveying continuously the molded surface fastener as the primary product and inserting the positioning member to the space region while moving along a conveying direction of the molded surface fastener when detecting a position of the molded surface fastener, and performing the cutting processing while the molded surface fastener is continuously conveyed by moving up and down a cutting punch having a tip cutting blade portion sloped outward from a center portion in the width direction of the substrate portion while moving the cutting punch along the conveying direction.

13. The method for manufacturing the molded surface fastener according to claim 10, including:

conveying continuously the molded surface fastener and inserting the positioning member to the space region by rotating a positioning roller on which the positioning members are disposed on the periphery in accordance with a conveying rate of the molded surface fastener when detecting a position of the molded surface fastener, and performing the cutting processing while the molded surface fastener is continuously conveyed by rotating a rotary die on which cutting blade portions are disposed on the periphery in accordance with the conveying rate of the molded surface fastener.

* * * * *